US008321207B2

(12) United States Patent
Edler et al.

(10) Patent No.: US 8,321,207 B2
(45) Date of Patent: Nov. 27, 2012

(54) DEVICE AND METHOD FOR POSTPROCESSING SPECTRAL VALUES AND ENCODER AND DECODER FOR AUDIO SIGNALS

(75) Inventors: Bernd Edler, Hannover (DE); Ralf Geiger, Nuremberg (DE); Christian Ertel, Igensdorf (DE); Johannes Hilpert, Nuremberg (DE); Harald Popp, Tuchenbach (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 845 days.

(21) Appl. No.: 12/446,772

(22) PCT Filed: Sep. 28, 2007

(86) PCT No.: PCT/EP2007/008477

§ 371 (c)(1),
(2), (4) Date: Apr. 23, 2009

(87) PCT Pub. No.: WO2008/052627

PCT Pub. Date: May 8, 2008

(65) Prior Publication Data

US 2010/0017213 A1 Jan. 21, 2010

(30) Foreign Application Priority Data

Nov. 2, 2006 (DE) ..... 10 2006 051 673

(51) Int. Cl.
*G10L 19/02* (2006.01)
*G10L 19/14* (2006.01)

(52) U.S. Cl. ..... 704/203; 704/205

(58) Field of Classification Search ..... None
See application file for complete search history.

(56) References Cited

U.S. PATENT DOCUMENTS 5,199,078 A 3/1993 Orglmeister
(Continued)

FOREIGN PATENT DOCUMENTS

DE 102 34 130 B3 2/2004
(Continued)

OTHER PUBLICATIONS

Official communication issued in counterpart German Application No. 10 2006 051 673.7, mailed on Apr. 16, 2008.

(Continued)

*Primary Examiner* — Brian Albertalli
(74) *Attorney, Agent, or Firm* — Keating & Bennett, LLP

(57) ABSTRACT

For postprocessing spectral values which are based on a first transformation algorithm for converting the audio signal into a spectral representation, first a sequence of blocks of the spectral values representing a sequence of blocks of samples of the audio signal are provided. Hereupon, a weighted addition of spectral values of the sequence of blocks of spectral values is performed in order to obtain a sequence of blocks of postprocessed spectral values, wherein the combination is performed such that for calculating a postprocessed spectral value for a frequency band and a time duration a spectral value of the sequence of blocks for the frequency band and the time duration and a spectral value for another frequency band or another time duration are used, wherein the combination is further performed such that such weighting factors are used that the postprocessed spectral values are an approximation to the spectral values as they are obtained by converting the audio signal into a spectral representation using a second transformation algorithm which is different from the first transformation algorithm. The postprocessed spectral values are in particular used for a difference formation within a scalable encoder or for an addition within a scalable decoder, respectively.

28 Claims, 11 Drawing Sheets

U.S. PATENT DOCUMENTS

| | | | | |
|---|---|---|---|---|
| 6,131,084 | A | 10/2000 | Hardwick | |
| 6,138,093 | A | 10/2000 | Ekudden et al. | |
| 7,275,036 | B2 | 9/2007 | Geiger et al. | |
| 7,343,287 | B2 * | 3/2008 | Geiger et al. | 704/230 |
| 7,406,410 | B2 | 7/2008 | Kikuiri et al. | |
| 7,707,030 | B2 * | 4/2010 | Edler et al. | 704/211 |
| 2004/0165667 | A1 | 8/2004 | Lennon et al. | |
| 2005/0114126 | A1 | 5/2005 | Geiger et al. | |
| 2005/0197831 | A1 | 9/2005 | Edler et al. | |
| 2006/0004583 | A1 | 1/2006 | Herre et al. | |
| 2007/0100610 | A1 | 5/2007 | Disch et al. | |
| 2007/0274383 | A1 * | 11/2007 | Yu et al. | 375/240.11 |
| 2008/0249766 | A1 | 10/2008 | Ehara | |
| 2009/0240507 | A1 * | 9/2009 | Jax et al. | 704/500 |
| 2009/0306993 | A1 * | 12/2009 | Wuebbolt et al. | 704/500 |
| 2010/0114581 | A1 * | 5/2010 | Li et al. | 704/500 |

FOREIGN PATENT DOCUMENTS

| | | | |
|---|---|---|---|
| EP | 1 495 464 | B1 | 9/2005 |
| JP | 2002-504294 | A | 2/2002 |
| JP | 2002-517019 | A | 6/2002 |
| JP | 2003-233400 | A | 8/2003 |
| JP | 2004-094132 | A | 3/2004 |
| JP | 2005-527851 | A | 9/2005 |
| RU | 2 199 157 | C2 | 2/2003 |
| RU | 2 214 048 | C2 | 10/2003 |
| TW | 200415922 | A | 8/2004 |
| WO | 99/53677 | A2 | 10/1999 |
| WO | 99/62052 | A2 | 12/1999 |
| WO | 2004/013839 | A1 | 2/2004 |
| WO | 2005/036528 | A1 | 4/2005 |
| WO | 2005/106848 | A1 | 11/2005 |
| WO | 2005/109240 | A1 | 11/2005 |

OTHER PUBLICATIONS

Official communication issued in counterpart International Application No. PCT/EP2007/008477, mailed on Feb. 22, 2008.

Geiger et al: "INTMDCT-A Link Between Perceptual and Lossless Audio Coding," XP010804248; 2002 IEEE International Conference on Acoustics, Speech, and Signal Processing; May 13, 2002; vol. 4; pp. 1813-1816.

Babel et al.: "Lossless and Lossy Minimal Redundancy Pyramidal Decomposition for Scalable Image Compression Technique," XP010650420; 2003 IEEE; Multimedia and Expo, 2003 Proceedings; Jul. 6, 2003; pp. 161-164.

Geiger et al.: "ISO/IEC MPEG-4 High Definition Scalable Advanced Audio Coding," Audio Engineering Society Convention Paper 6791; AES 120th Convention; May 20-23, 2006; pp. 1-20.

Edler: "Codierung Von Audiosignalen Mit Überlappender Transformation Und Adaptiven Fensterfunktionen," in: Frequenz, 43; 1989; pp. 252-256.

Grill et al.: "A Two or Three-Stage Bit Rate Scalable Audio Coding System," Proceedings of the 99th AES Convention; Oct. 6-9, 1995; 5 pages.

Official Communication issued in corresponding Japanese Patent Application No. 2009-534996, mailed on Oct. 11, 2011.

Yokotani et al., "Lossless Audio Coding Using the IntMDCT and Rounding Error Shaping", IEEE Transactions on Audio, Speech, and Language Processing, IEEE Service Center, vol. 14, No. 6, Nov. 1, 2006, pp. 2201-2211.

Official communication issued in counterpart European Application No. 10 17 3938, mailed on Sep. 6, 2012.

* cited by examiner encoder side decoder side $$d(k, n) = y(k, n) - y(k, n)$$

$$\hat{y}(k, n) = c_0(k)x(k-1, n-1) + c_1(k)x(k-1, n) + c_2(k)x(k-1, n+1) + c_3(k)x(k, n-1) + c_4(k)x(k, n) + c_5(k)x(k, n+1) + c_6(k)x(k+1, n-1) + c_7(k)x(k+1, n) + c_8(k)x(k+1, n+1)$$

wherein $k = 0...575$

LONG BLOCKS $$d(k, n, u) = y(k, n, u) - \hat{y}(k, n, u), \text{ wherein}$$

$$\begin{aligned} y(k, n, u) = {} & c_0(k, u)x(k-1, n, 0) + c_1(k, u)x(k-1, n, 1) + c_2(k, u)x(k-1, n, 2) \\ & + c_3(k, u)x(k, n, 0) + c_4(k, u)x(k, n, 1) + c_5(k, u)x(k, n, 2) \\ & + c_6(k, u)x(k+1, n, 0) + c_7(k, u)x(k+1, n, 1) + c_8(k, u)x(k+1, n, 2) \end{aligned}$$

wherein $k = 0 \ldots 191$, $u = 0 \ldots 2$

SHORT BLOCKS - 1. variant n: block index (time index) k: frequency index s: orderindex $$d(3k+s, n) = y(3k+s, n) - \hat{y}(3k+s, n)$$

$$\begin{aligned}\hat{y}(3k+s, n) = {} & c_0(k, s)x(k-1, n, 0) + c_1(k, s)x(k-1, n, 1) + c_2(k, s)x(k-1, n, 2) \\ & + c_3(k, s)x(k, n, 0) + c_4(k, s)x(k, n, 1) + c_5(k, s)x(k, n, 2) \\ & + c_6(k, s)x(k+1, n, 0) + c_7(k, s)x(k+1, n, 1) + c_8(k, s)x(k+1, n, 2)\end{aligned}$$

wherein $k = 0...191$, $s=0...2$

SHORT BLOCKS - 2. variant

Encoder

Decoder

DEVICE AND METHOD FOR POSTPROCESSING SPECTRAL VALUES AND ENCODER AND DECODER FOR AUDIO SIGNALS

The present invention relates to audio encoding/decoding and in particular to scalable encoder/decoder concepts having a base layer and an extension layer.

BACKGROUND OF THE INVENTION

Audio encoders/decoders have been known for a long time. In particular audio encoders/decoders operating according to the standard ISO/IEC 11172-3, wherein this standard is also known as the MP3 standard, are referred to as transformation encoders. Such an MP3 encoder receives a sequence of time samples as an input signal which are subjected to a windowing. The windowing leads to sequential blocks of time samples which are then converted into a spectral representation block by block. According to the MP3 standard, here a conversion is performed with a so-called hybrid filter bank. The first stage of the hybrid filter bank is a filter bank having 32 channels in order to generate 32 subband signals. The subband filters of this first stage comprise overlapping passbands, which is why this filtering is prone to aliasing. The second stage is an MDCT stage to divide the 32 subband signals into 576 spectral values. The spectral values are then quantized considering the psychoacoustic model and subsequently Huffman encoded in order to finally obtain a sequence of bits including a stream of Huffman code words and side information for decoding.

On the decoder side, the Huffman code words are then calculated back into quantization indices. A requantization leads to spectral values which are then fed into a hybrid synthesis filter bank which is implemented analog to the analysis filter bank to again obtain blocks of time samples of the encoded and again decoded audio signal. All steps on the encoder side and on the decoder side are presented in the MP3 standard. With regard to the terminology it is noted that in the following reference is also made to an "inverse quantization". Although a quantization is not invertible, as it involves an irretrievable data loss, the expression inverse quantization is often used, which is to indicate a requantization presented before.

Also an audio encoder/decoder algorithm called AAC (AAC=Advanced Audio Coding) is known in the art. Such an encoder standardized in the international standard ISO/IEC 13818-7 again operates on the basis of time samples of an audio signal. The time samples of the audio signal are again subjected to a windowing in order to obtain sequential blocks of windowed time samples. In contrast to the MP3 encoder in which a hybrid filter bank is used, in the AAC encoder one single MDCT transformation is performed in order to obtain a sequence of blocks of MDCT spectral values. These MDCT spectral values are then again quantized on the basis of a psychoacoustic model and the quantized spectral values are finally Huffman encoded. On the decoder side processing is correspondingly. The Huffman code words are decoded and the quantization indices or quantized spectral values, respectively, obtained therefrom are then requantized or inversely quantized, respectively, to finally obtain spectral values that may be supplied to an MDCT synthesis filter bank in order to finally obtain encoded/decoded time samples again.

Both methods operate with overlapping blocks and adaptive window functions as described in the experts publication "Codierung von Audiosignalen mit überlappender Transformation und adaptiven Fensterfunktionen", Bernd Edler, Frequenz, vol. 43, 1989, pp. 252-256.

In particular when transient areas are determined in the audio signal, a switch is performed from long window functions to short window functions in order to obtain a reduced frequency resolution in favor of a better time resolution. A sequence of short windows is introduced by a start window and a sequence of short windows is terminated by stop a window. Thereby, a gapless transition between overlapping long window functions to overlapping short window functions may be achieved. Depending on the implementation, the overlapping area with short windows is smaller than the overlapping area with long windows, which is reasonable with regard to the fact that transient signal portions are present in the audio signal, does not necessarily have to be the case, however. Thus, sequences of short windows as well as sequences of long windows may be implemented with an overlap of 50 percent. In particular with short windows, however, for improving the encoding of transient signal portions, a reduced overlap width may be selected, like for example only 10 percent or even less instead of 50 percent.

Both, in the MP3 standard and also in the AAC standard the windowing exists with long and short windows and the start windows or stop windows, respectively, are scaled such that in general the same block raster may be maintained. For the MP3 standard this means, that for each long block 576 spectral values are generated and that three short blocks correspond to one long block. This means, that one short block generates 192 spectral values. With an overlap of 50 percent, for windowing thus a window length of 1152 time samples is used, as due to the overlap and add principle of a 50 percent overlap two blocks of time samples always lead to one block of spectral values.

Both with MP3 encoders and also with AAC encoders, a lossy compression takes place. Losses are introduced by a quantization of the spectral values taking place. The spectral values are in particular quantized so that the distortions introduced by the quantization also referred to as quantization noise have an energy which is below the psychoacoustic masking threshold.

The coarser an audio signal is quantized, i.e. the greater the quantizer step size, the higher the quantization noise. On the other hand, however, for a coarser quantization a smaller set of quantizer output values is to be considered, so that values quantized coarser may be entropy encoded using less bits. This means, that a coarser quantization leads to a higher data compression, however simultaneously leads to higher signal losses.

These signal losses are unproblematic if they are below the masking threshold. Even if the psychoacoustic masking threshold is only exceeded slightly, this may possibly not yet lead to audible interferences for unskilled listeners. Anyway, however, an information loss takes place which may be undesired for example due to artifacts which may be audible in certain situations.

In particular with broadband data connections or when the data rate is not the decisive parameter, respectively, or when both broadband and also narrowband data networks are available, it may be desirable to have not a lossy but a lossless or almost lossless, compressed presentation of an audio signal.

Such a scalable encoder schematically illustrated in FIG. 7 and an associated decoder schematically illustrated in FIG. 8 are known from the experts publication "INTMDCT—A Link Between Perceptual And Lossless Audio Coding", Ralf Geiger, Jürgen Herre, Jürgen Koller, Karlheinz Brandenburg, Int. Conference on Acoustics Speech and Signal Processing (ICASSP), 13-17 May, 2002, Orlando, Fla. A similar technology is described in the European Patent EP 1 495 464 B1. The elements 71, 72, 73, 74 illustrate an AAC encoder in order to generate a lossy encoded bit stream referred to as "perceptually coded bitstream" in FIG. 7. This bit stream represents the base layer. In particular, block 71 in FIG. 7 designates the analysis filter bank including the windowing with long and short windows according to the AAC standard. Block 73 represents the quantization/encoding according to the AAC standard and block 74 represents the bit stream generation so that the bit stream on the output side not only includes Huffman code words of quantized spectral values but also the side information, like for example scale factors, etc., so that a decoding may be performed. The lossy quantization in block 73 is here controlled by the psychoacoustic model designated as the "perceptual model" 72 in FIG. 7.

As already indicated, the output signal of block 74 is a base scaling layer which necessitates relatively few bits and is, however, only a lossy representation of the original audio signal and may comprise encoder artifacts. The blocks 75, 76, 77, 78 represent the additional elements which are needed to generate an extension bit stream which is lossless or virtually lossless, as it is indicated in FIG. 7. In particular, the original audio signal is subjected to an integer MDCT (IntMDCT) at the input 70, as it is illustrated by block 75. Further, the quantized spectral values, generated by block 73, into which encoder losses are already introduced, are subjected to an inverse quantization and to a subsequent rounding in order to obtain rounded spectral values. Those are supplied to a difference former 77 forming a spectral-value-wise difference which is then subjected to an entropy coding in block 78 in order to generate a lossless enhancement bit stream of the scaling scheme in FIG. 7. A spectrum of differential values at the output of block 77 thus represents the distortion introduced by the psychoacoustic quantization in block 73.

On the decoder side the lossy coded bit stream or the perceptually coded bit stream is supplied to a bit stream decoder 81. On the output side, block 81 provides a sequence of blocks of quantized spectral values which are then subjected to an inverse quantization in a block 82. At the output of block 82 thus inversely quantized spectral values are present which now, in contrast to the values at the input of block 82, do not represent quantizer indices anymore, but which are now so to say "correct" spectral values which, however, are different from the spectral values before the encoding in block 73 of FIG. 7 due to the lossy quantization. These quantized spectral values are now supplied to a synthesis filter bank or an inverse MDCT transformation (inverse MDCT), respectively, in block 83 to obtain a psychoacoustically encoded and again decoded audio signal (perceptual audio) which is different from the original audio signal at the input 70 of FIG. 7 due to the encoding errors introduced by the encoder of FIG. 7. In order to not only obtain a lossy but even a lossless compression, the audio signal of block 82 is supplied to a rounding in a block 84. In an adder 85 now the rounded, inversely quantized spectral values are added to the differential values which were generated by the difference former 77, wherein in a block 86 an entropy decoding is performed to decode the entropy code words contained in the extension bit stream containing the lossless or virtually lossless information, respectively.

At the output of block 85, IntMDCT spectral values are thus present which are in the optimum case identical to the MDCT spectral values at the output of block 75 of the encoder of FIG. 7. The same are then subjected to an inverse integer MDCT (inverse IntMDCT), to obtain a coded lossless audio signal or virtually lossless audio signal (lossless audio) at the output of block 87.

The integer MDCT (IntMDCT) is an approximation of the MDCT, however, generating integer output values. It is derived from the MDCT using the lifting scheme. This works in particular when the MDCT is divided into so-called Givens rotations. Then, a two-stage algorithm with Givens rotations and a subsequent DCT-IV result as the integer MDCT on the encoder side and with a DCT-IV and a downstream number of Givens rotations on the decoder side. In the scheme of FIG. 7 and FIG. 8, thus the quantized MDCT spectrum generated in the AAC encoder is used to predicate the integer MDCT spectrum. In general, the integer MDCT is thus an example for an integer transformation generating integer spectral values and again time samples from the integer spectral values, without losses being introduced by rounding errors. Other integer transformations exist apart from the integer MDCT.

The scaling scheme indicated in FIGS. 7 and 8 is only sufficiently efficient when the differences at the output of the difference former 77 are small. In the scheme illustrated in FIG. 7 this is the case, as the MDCT and the integer MDCT are similar and as the IntMDCT in block 75 is derived from the MDCT in block 71, respectively. If this was not the case, the scheme illustrated there would not be suitable, as then the differential values would in many cases be greater than the original MDCT values or even greater than the original IntMDCT values. Then the scaling scheme in FIG. 7 has lost its value as the extension scaling layer output by block 78 has a high redundancy regarding the base scaling layer.

Scalability schemes are always optimal when the base layer comprises a number of bits and when the extension layer comprises a number of bits and when the sum of the bits in the base layer and in the extension layer is equal to a number of bits which would be obtained if the base layer already were a lossless encoding. This optimum case is never achieved in practical scalability schemes, as for the extension layer additional signaling bits are necessitated. This optimum is, however, aimed at as far as possible. As the transformations in blocks 71 and 75 are relatively similar in FIG. 7, the concept illustrated in FIG. 7 is close to optimum.

This simple scalability concept may, however, not just like that be applied to the output signal of an MP3 encoder, as the MP3 encoder, as it was illustrated, comprises no pure MDCT filter bank as a filter bank, but the hybrid filter bank having a first filter bank stage for generating different subband signals and a downstream MDCT for further breaking down the subband signals, wherein in addition, as it is also indicated in the MP3 standard, an additional aliasing cancellation stage of the hybrid filter bank is implemented. As the integer MDCT in block 75 of FIG. 7 has little similarities with the hybrid filter bank according to the MP3 standard, a direct application of the concept shown in FIG. 7 to an MP3 output signal would lead to very high differential values at the output of the difference former 77, which results in an extremely inefficient scalability concept, as the extension layer necessitates far too many bits in order to reasonably encode the differential values at the output of the difference former 77.

A possibility for generating the extension bit stream for an MP3 output signal is illustrated in FIG. 9 for the encoder and in FIG. 10 for the decoder. An MP3 encoder 90 encodes an audio signal and provides a base layer 91 on the output side. The MP3 encoded audio signal is then supplied to an MP3 decoder 92 providing a lossy audio signal in the time range. This signal is then supplied to an IntMDCT block which may in principle be setup just like block 75 in FIG. 7, wherein this block 75 then provides IntMDCT spectral values on the output side which are supplied to a difference former 77 which also includes IntMDCT spectral values as further input values, which were, however, not generated by the MP3 decoded audio signal but by the original audio signal which was supplied to the MP3 encoder 90.

On the decoder side, the base layer is again supplied to an MP3 decoder 92 to provide a lossy decoded audio signal at an output 100 which would correspond to the signal at the output of block 83 of FIG. 8. This signal would then have to be subjected to an integer MDCT 75 to then be encoded together with the extension layer 93 which was generated at the output of the difference former 77. The lossless spectrum would then be present at an output 101 of the adder 102 and would only have to be converted by means of an inverse IntMDCT 103 into the time range in order to obtain a losslessly decoded audio signal which would correspond to the "lossless audio" at the beginning of block 87 of FIG. 8.

The concept illustrated in FIG. 9 and in FIG. 10, which provides a relatively efficiently encoded extension layer just like the concepts illustrated in FIGS. 7 and 8, is expensive both on the encoder side (FIG. 9) and also on the decoder side (FIG. 10), respectively. In contrast to the concept in FIG. 7, a complete MP3 decoder 92 and an additional IntMDCT 75 are necessitated.

Another disadvantage in this scheme is, that a bit-accurate MP3 decoder would have to be defined. This is not intended, however, as the MP3 standard does not represent a bit-accurate specification but only has to be fulfilled within the scope of a "conformance" by a decoder.

On the decoder side, further a complete additional IntMDCT stage 75 is necessitated. Both additional elements cause computational overhead and are disadvantageous in particular for use in mobile devices both with regard to chip consumption and also current consumption and also with regard to the associated delay.

In summary, advantages of the concept illustrated in FIG. 7 and FIG. 8 are, that compared to time domain methods no complete decoding of the audio-adapted encoded signal is necessitated, and that an efficient encoding is obtained by a representation of the quantization error in the frequency range to be encoded additionally. Thus, the method standardized by ISO/IEC MPEG-4 Scalable Lossless Coding (SLS) uses this approach, as described in R. Geiger, R. Yu, J. Herre, S. Rahardja, S. Kim, X. Lin, M. Schmidt, "ISO/IEC MPEG-4 High-Definition Scalable Advanced Audio Coding", 120th AES meeting, May 20-23, 2006, Paris, France, Preprint 6791. Thus, a backward compatible, lossless extension of audio encoding methods, for example MPEG-2/4 AAC, is obtained which use the MDCT as a filter bank.

This approach may, however, not directly be applied to the widely used method MPEG-½ Layer 3 (MP3), as the hybrid filter bank used in this method, in contrast to the MDCT, is not compatible with the IntMDCT or another integer transformation. Thus, a difference formation between the decoded spectral values and the corresponding IntMDCT values in general does not lead to small differential values and thus not to an efficient encoding of the differential values. The core of the problem here is the time shifts between the corresponding modulation functions of the IntMDCT and the MP3 hybrid filter bank. These lead to phase shifts which in unfavorable cases even lead to the fact that the differential values comprise higher values than the IntMDCT values. Also an application of the principles underlying the IntMDCT, like for example the lifting scheme, to the hybrid filter bank of MP3 is problematic, as regarding its basic approach—in contrast to MDCT—the hybrid filter bank is a filter bank which provides no perfect reconstruction.

SUMMARY

According to an embodiment, a device for postprocessing spectral values based on a first transformation algorithm for converting an audio signal into a spectral representation may have: a means for providing a sequence of blocks of the spectral values representing a sequence of blocks of samples of the audio signal; and a combiner for weightedly adding spectral values of the sequence of blocks of spectral values in order to obtain a sequence of blocks of postprocessed spectral values, wherein the combiner is implemented to use, for the calculation of a postprocessed spectral value for a frequency band and a time duration, a spectral value of the sequence of blocks for the frequency band and the time duration, and a spectral value for another frequency band or another time duration, and wherein the combiner is implemented to use such weighting factors when weightedly adding, that the postprocessed spectral values are an approximation to spectral values as they are obtained by a second transformation algorithm for converting the audio signal into a spectral representation, wherein the second transformation algorithm is different from the first transformation algorithm.

According to another embodiment, an encoder for encoding an audio signal may have: a device for postprocessing spectral values based on a first transformation algorithm for converting an audio signal into a spectral representation, having: a means for providing a sequence of blocks of the spectral values representing a sequence of blocks of samples of the audio signal; and a combiner for weightedly adding spectral values of the sequence of blocks of spectral values in order to obtain a sequence of blocks of postprocessed spectral values, wherein the combiner is implemented to use, for the calculation of a postprocessed spectral value for a frequency band and a time duration, a spectral value of the sequence of blocks for the frequency band and the time duration, and a spectral value for another frequency band or another time duration, and wherein the combiner is implemented to use such weighting factors when weightedly adding, that the postprocessed spectral values are an approximation to spectral values as they are obtained by a second transformation algorithm for converting the audio signal into a spectral representation, wherein the second transformation algorithm is different from the first transformation algorithm; a means for calculating a sequence of blocks of spectral values according to the second transformation algorithm from the audio signal; a means for a spectral-value-wise difference formation between the sequence of blocks due to the second transformation algorithm and the sequence of blocks of postprocessed spectral values.

According to another embodiment, a decoder for decoding an encoded audio signal ma have: a device for postprocessing spectral values based on a first transformation algorithm for converting an audio signal into a spectral representation, having: a means for providing a sequence of blocks of the spectral values representing a sequence of blocks of samples of the audio signal; and a combiner for weightedly adding spectral values of the sequence of blocks of spectral values in order to obtain a sequence of blocks of postprocessed spectral values, wherein the combiner is implemented to use, for the calculation of a postprocessed spectral value for a frequency band and a time duration, a spectral value of the sequence of blocks for the frequency band and the time duration, and a spectral value for another frequency band or another time duration, and wherein the combiner is implemented to use such weighting factors when weightedly adding, that the postprocessed spectral values are an approximation to spectral values as they are obtained by a second transformation algorithm for converting the audio signal into a spectral representation, wherein the second transformation algorithm is different from the first transformation algorithm; a means for providing spectral-value-wise differential values between a sequence of blocks of postprocessed spectral values due to the first transformation algorithm and a sequence of blocks due to the second transformation algorithm; a means for combining the sequence of blocks of the postprocessed spectral values and the differential values in order to obtain a sequence of blocks of combination spectral values; and a means for inversely transforming the sequence of blocks of combination spectral values according to the second transformation algorithm to obtain a decoded audio signal.

According to another embodiment, a method for postprocessing spectral values which are based on a first transformation algorithm for converting an audio signal into a spectral representation may have the following steps: providing a sequence of blocks of the spectral values representing a sequence of blocks of samples of the audio signal; and weightedly adding of spectral values of the sequence of blocks of spectral values to obtain a sequence of blocks of postprocessed spectral values, wherein for calculating a postprocessed spectral value for a frequency band and a time duration a spectral value of the sequence of blocks for the frequency band and the time duration and a spectral value for another frequency band or another time duration are used, and wherein such weighting factors are used when weightedly adding so that the postprocessed spectral values are an approximation to spectral values as they are obtained by a second transformation algorithm for converting the audio signal into a spectral representation, wherein the second transformation algorithm is different from the first transformation algorithm.

According to another embodiment, a method for encoding an audio signal may have the following steps: postprocessing of spectral values which are based on a first transformation algorithm for converting an audio signal into a spectral representation, having the following steps: providing a sequence of blocks of the spectral values representing a sequence of blocks of samples of the audio signal; and weightedly adding of spectral values of the sequence of blocks of spectral values to obtain a sequence of blocks of postprocessed spectral values, wherein for calculating a postprocessed spectral value for a frequency band and a time duration a spectral value of the sequence of blocks for the frequency band and the time duration and a spectral value for another frequency band or another time duration are used, and wherein such weighting factors are used when weightedly adding so that the postprocessed spectral values are an approximation to spectral values as they are obtained by a second transformation algorithm for converting the audio signal into a spectral representation, wherein the second transformation algorithm is different from the first transformation algorithm; calculating a sequence of blocks of spectral values according to the second transformation algorithm from the audio signal; spectral-value-wise difference formation between the sequence of blocks of spectral values due to the second transformation algorithm and the sequence of blocks of postprocessed spectral values.

According to another embodiment, a method for decoding an encoded audio signal may have the following steps: postprocessing spectral values which are based on a first transformation algorithm for converting an audio signal into a spectral representation, having the following steps: providing a sequence of blocks of the spectral values representing a sequence of blocks of samples of the audio signal; and weightedly adding of spectral values of the sequence of blocks of spectral values to obtain a sequence of blocks of postprocessed spectral values, wherein for calculating a postprocessed spectral value for a frequency band and a time duration a spectral value of the sequence of blocks for the frequency band and the time duration and a spectral value for another frequency band or another time duration are used, and wherein such weighting factors are used when weightedly adding so that the postprocessed spectral values are an approximation to spectral values as they are obtained by a second transformation algorithm for converting the audio signal into a spectral representation, wherein the second transformation algorithm is different from the first transformation algorithm; providing of spectral-value-wise differential values between a sequence of blocks of postprocessed spectral values due to the first transformation algorithm and a sequence of blocks of spectral values due to the second transformation algorithm; combining the sequence of blocks of the postprocessed spectral values and the differential values to obtain a sequence of blocks of combination spectral values; and inversely transforming the sequence of blocks of combination spectral values according to the second transformation algorithm to obtain a decoded audio signal.

Another embodiment may have a computer program having a program code for performing the method for postprocessing spectral values which are based on a first transformation algorithm for converting an audio signal into a spectral representation, the method having the following steps: providing a sequence of blocks of the spectral values representing a sequence of blocks of samples of the audio signal; and weightedly adding of spectral values of the sequence of blocks of spectral values to obtain a sequence of blocks of postprocessed spectral values, wherein for calculating a postprocessed spectral value for a frequency band and a time duration a spectral value of the sequence of blocks for the frequency band and the time duration and a spectral value for another frequency band or another time duration are used, and wherein such weighting factors are used when weightedly adding so that the postprocessed spectral values are an approximation to spectral values as they are obtained by a second transformation algorithm for converting the audio signal into a spectral representation, wherein the second transformation algorithm is different from the first transformation algorithm, when the computer program runs on a computer.

Another embodiment may have a bit stream extension layer for inputting into an audio decoder, wherein the bit stream extension layer has a sequence of blocks of differential values, wherein a block of differential values has, spectral-value-wise, a difference between a block of spectral values as it is obtained from a second transformation algorithm and a block of postprocessed spectral values, wherein the postprocessed spectral values are generated by a weighted adding of spectral values of a sequence of blocks, as they are obtained from a first transformation algorithm, wherein for calculating a postprocessed spectral value for a frequency band and a time duration, a spectral value of the sequence of blocks for the frequency band and the time duration and a spectral value for another frequency band or another time duration are used, and wherein for combining weighting factors are used such that the postprocessed spectral values represent an approximation to spectral values as they are obtained by the second transformation algorithm, wherein the second transformation algorithm is different from the first transformation algorithm.

The present invention is based on the finding, that spectral values, for example representing the base layer of a scaling scheme, i.e. e.g. MP3 spectral values, are subjected to postprocessing, to obtain values therefrom which are compatible with corresponding values obtained according to an alternative transformation algorithm. According to the invention, thus such a postprocessing is performed using weighted additions of spectral values so that the result of the postprocessing is as similar as possible to a result which is obtained when the same audio signal is not converted into a spectral representation using the first transformation algorithm but using the second transformation algorithm, which is, in embodiments of the present invention, an integer transformation algorithm.

It is thus been found, that even with a strongly incompatible first transformation algorithm and second transformation algorithm, by a weighted addition of certain spectral values of the first transformation algorithm, a compatibility of the postprocessed values with the results of the second transformation is achieved which is so good that an efficient extension layer may be formed with differential values, without the expensive and thus disadvantageous coding and decoding of the concept in FIG. 9 and FIG. 10 being necessitated. In particular, the weighted addition is performed so that a postprocessed spectral value is generated from a weighted addition of a spectral value and an adjacent spectral value at the output of the first transformation algorithm, wherein both spectral values from adjacent frequency ranges and also spectral values from adjacent time blocks or time periods, respectively, are used. By the weighted addition of adjacent spectral values it is considered that in the first transformation algorithm adjacent filters of a filter bank overlap, as it is the case virtually with all filter banks. By the use of temporally adjacent spectral values, i.e. by the weighted addition of spectral values (e.g. of the same or only a slightly different frequency) of two subsequent blocks of spectral values of the first transformation it is further considered that typically transformation algorithms are used in which a block overlap is used.

The weighting factors are permanently programmed both on the encoder side and also on the decoder side, so that no additional bits are necessitated to transfer weighting factors. Instead, the weighting factors are set once and e.g. stored as a table or firmly implemented in hardware, as the weighting factors are not signal-dependent but only dependent on the first transformation algorithm and on the second transformation algorithm. In particular, it is advantageous to set the weighting factors so that an impulse response of the construction of first transformation algorithm and postprocessing is equal to an impulse response of the second transformation algorithm. In this respect, an optimization of the weighting factors may be employed manually or computer-aided using known optimization methods, for example using certain representative test signals or, as indicated, directly using the impulse responses of the resulting filters.

The same postprocessing device may be used both on the encoder side and also on the decoder side in order to adapt actually incompatible spectral values of the first transformation algorithm to spectral values of the second transformation algorithm, so that both blocks of spectral values may be subjected to a difference formation in order to finally provide an extension layer for an audio signal which is for example an MP3 encoded signal in the base layer and comprises the lossless extension as the extension layer.

It is to be noted, that the present invention is not limited to the combination of MP3 and integer MDCT, but that the present invention is of use everywhere, when spectral values of actually incompatible transformation algorithms are to be processed together, for example for the purpose of a difference formation, an addition or any other combination operation in an audio encoder or an audio decoder. The advantageous use of the inventive postprocessing device is, however, to provide an extension layer for a base layer in which an audio signal is encoded with a certain quality, wherein the extension layer, together with the base layer, serves to achieve a higher-quality decoding, wherein this higher-quality decoding already is a lossless decoding, but may, however, also be a virtually lossless decoding, as long as the quality of the decoded audio signal is improved using the extension layer as compared to the decoding using only the base layer.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
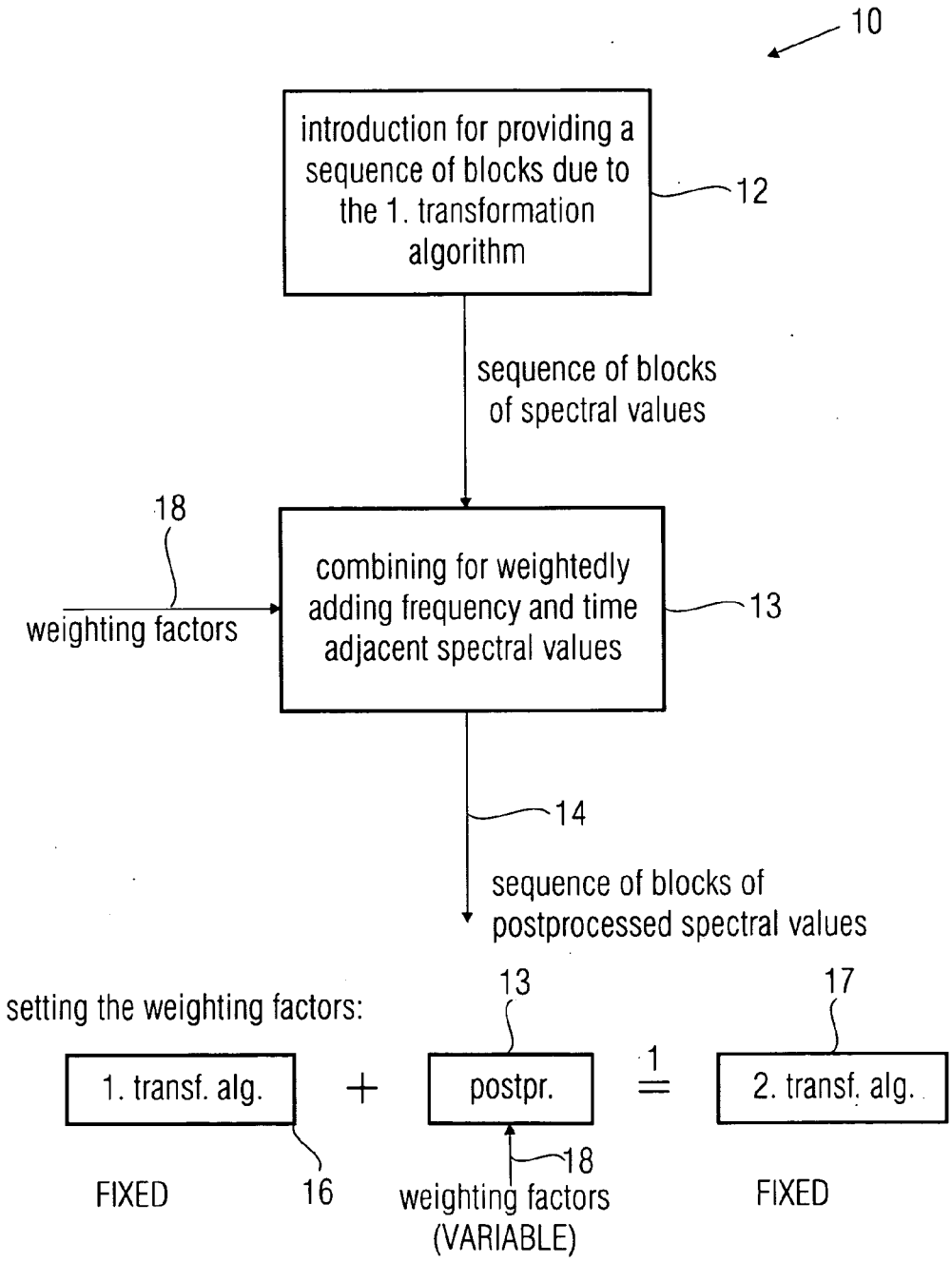
FIG. 1 is an inventive device for postprocessing spectral values.

FIG. 1 shows an inventive device for postprocessing spectral values which are advantageously a lossy representation of an audio signal, wherein the spectral values have an underlying first transformation algorithm for converting the audio signal into a spectral representation independent of the fact whether they are lossy or not lossy. The inventive device illustrated in FIG. 1 or the method also schematically illustrated in FIG. 1, respectively, distinguish themselves—with reference to the device—by a means 12 for providing a sequence of blocks of spectral values representing a sequence of blocks of samples of the audio signal. In an embodiment of the present invention which will be illustrated later, the sequence of blocks provided by means 12 is a sequence of blocks generated by an MP3 filter bank. The sequence of blocks of spectral values is supplied to an inventive combiner 13, wherein the combiner is implemented to perform a weighted addition of spectral values of the sequence of blocks of spectral values to obtain, on the output side, a sequence of blocks of postprocessed spectral values, as it is illustrated by output 14. In particular, the combiner 13 is implemented to use, for calculating a postprocessed spectral value for a frequency band and a time period, a spectral value of the sequence of blocks for the frequency band and the time period and a spectral value for an adjacent frequency band and/or an adjacent time period. Further, the combiner is implemented to use such weighting factors for weighting the used spectral values, that the postprocessed spectral values are an approximation to spectral values obtained by a second transformation algorithm for converting the audio signal into a spectral representation, wherein, however, the second transformation algorithm is different from the first transformation algorithm.

Figure 4:
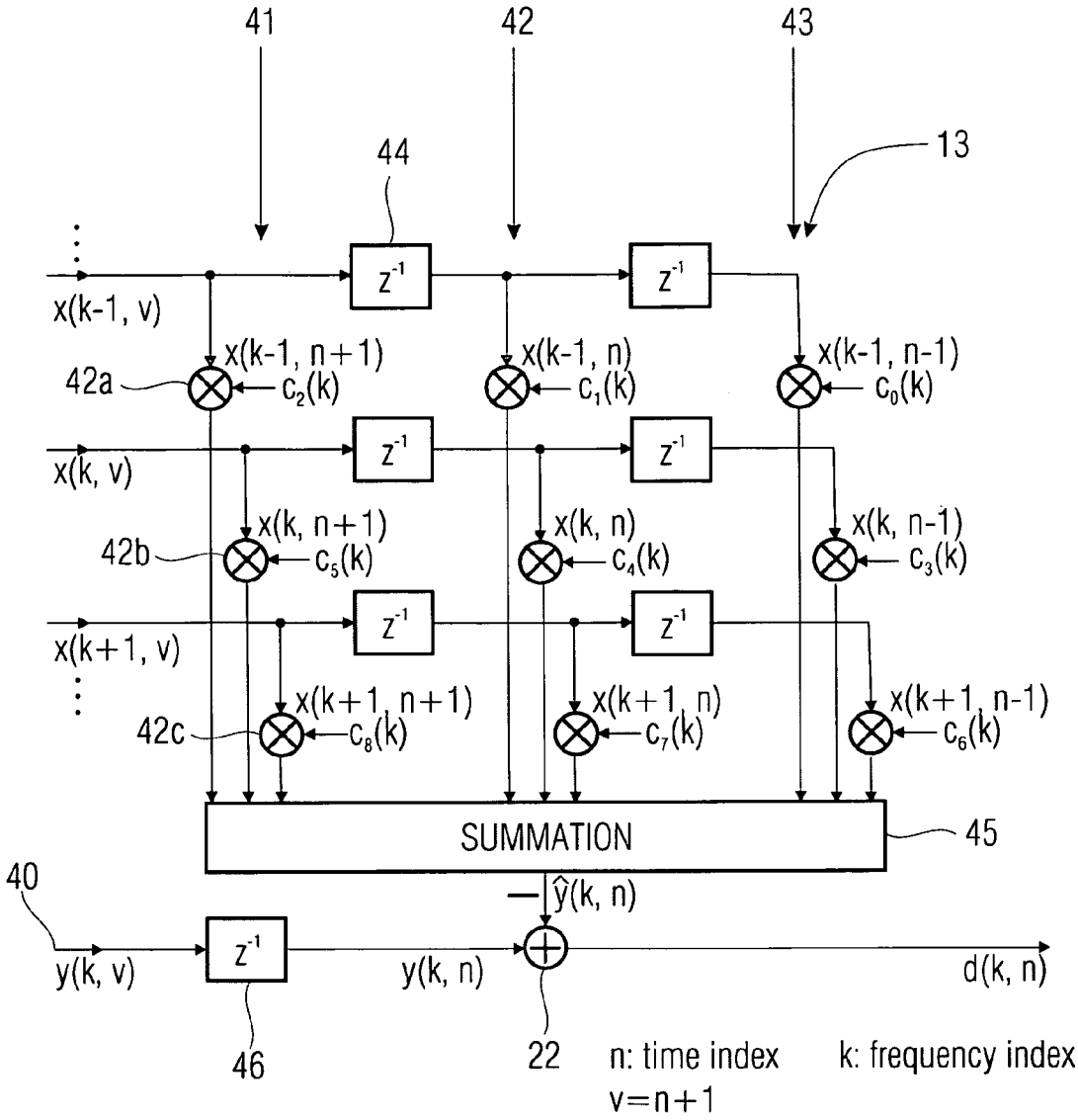
FIG. 4 is a detailed illustration of an embodiment of the inventive postprocessing and difference formation for long blocks.

This is illustrated by the schematical illustration in FIG. 1 at the bottom. A first transformation algorithm is represented by a reference numeral 16. The postprocessing, as it is performed by the combiner, is represented by the reference numeral 13, and the second transformation algorithm is represented by a reference numeral 17. Of blocks 16, 13 and 17, blocks 16 and 17 are fixed and typically mandatory due to external conditions. Only the weighting factors of the postprocessing means 13 or the combiner 13, respectively, represented by reference numeral 18, may be set by the user. In this connection, this is not signal-dependent but depending on the first transformation algorithm and the second transformation algorithm, however. By the weighting factors 18 it may further be set, how many spectral values adjacent regarding frequency or spectral values adjacent in time are combined with each other. If a weighting factor, as it will be explained with reference to FIGS. 4 to 6, is set to 0, the spectral value associated with this weighting factor is not considered in the combination.

In embodiments of the present invention, for each spectral value a set of weighting factors is provided. Thus, a considerable amount of weighting factors result. This is unproblematic, however, as the weighting factors do not have to be transferred but only have to be permanently programmed to the encoder side and the decoder side. If encoder and decoder thus agreed on the same set of weighting factors for each spectral value and, if applicable, for each time period, or, as it will be illustrated in the following, for each subblock or ordering position, respectively, no signaling has to be used for the present invention, so that the inventive concept achieves a substantial reduction of the data rate in the extension layer without any signaling of additional information, without any accompanying quality losses.

The present invention thus provides a compensation of the phase shifts between frequency values, as they are obtained by the first transformation algorithm, and frequency values, as they are obtained by the second transformation algorithm, wherein this compensation of the phase shifts may be presented via a complex spectral representation. For this purpose, the concept described in DE 10234130 is included for reasons of clarity, in which for calculating imaginary parts from real filter bank output values linear combinations of temporally and spectrally adjacent spectral values are obtained. If this procedure was used for decoded MP3 spectral values, a complex-valued spectral representation would be obtained. Each of the resulting complex spectral values may now be modified in its phase position by a multiplication by a complex-valued correction factor so that, according to the present invention, it gets as close to the second transformation algorithm as possible, i.e. the corresponding IntMDCT value, and is thus suitable for a difference formation. Further, according to the invention, also a possibly necessitated amplitude correction is performed. According to the invention, these steps for the formation of the complex-valued spectral representation and the phase or sum correction, respectively, are summarized such that by the linear combination of spectral values on the basis of the first transformation algorithm and its temporal and spectral neighbors a new spectral value is formed which minimizes the difference to the corresponding IntMDCT value. According to the invention, in contrast to the DE 10234130, a postprocessing of filter bank output values is not performed using weighting factors in order to obtain real and imaginary parts. Instead, according to the invention a postprocessing is performed using such weighting factors that, as it was illustrated in FIG. 1 at the bottom, a combination of the first transformation algorithm 16 and the postprocessing 13 is set by the weighting factors so that the result corresponds to a second transformation algorithm as far as possible.

Figure 2:
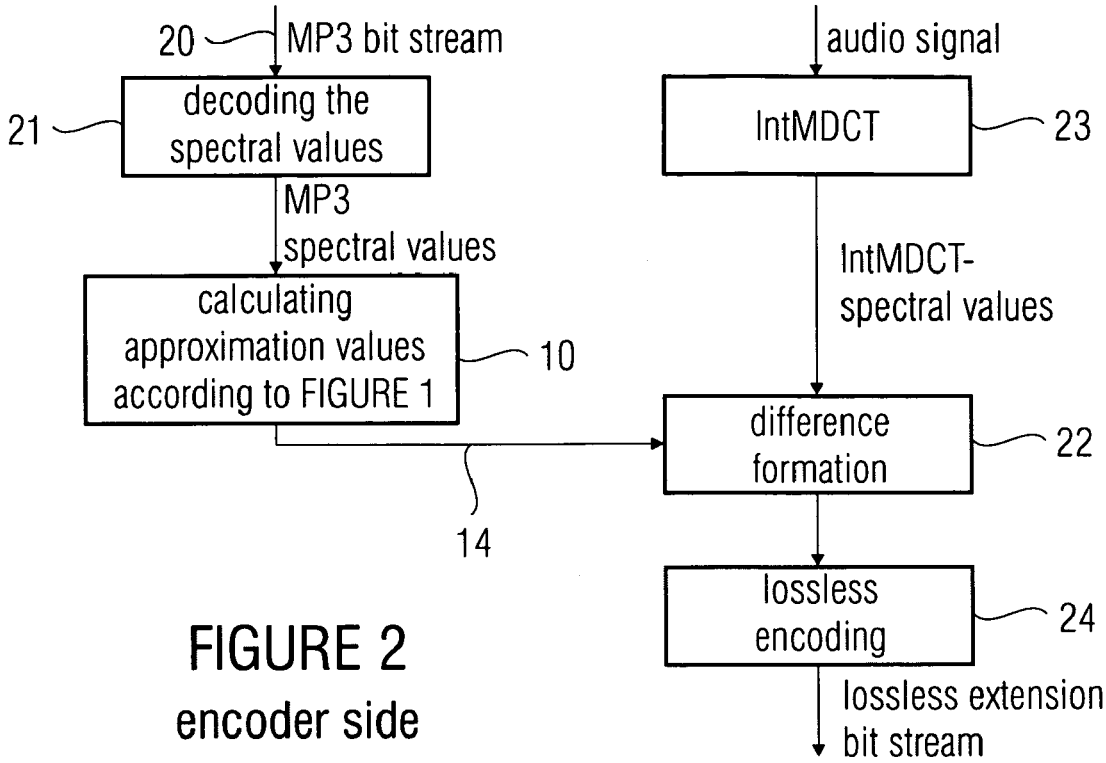
FIG. 2 is an encoder side of an inventive encoder concept.
Figure 3:
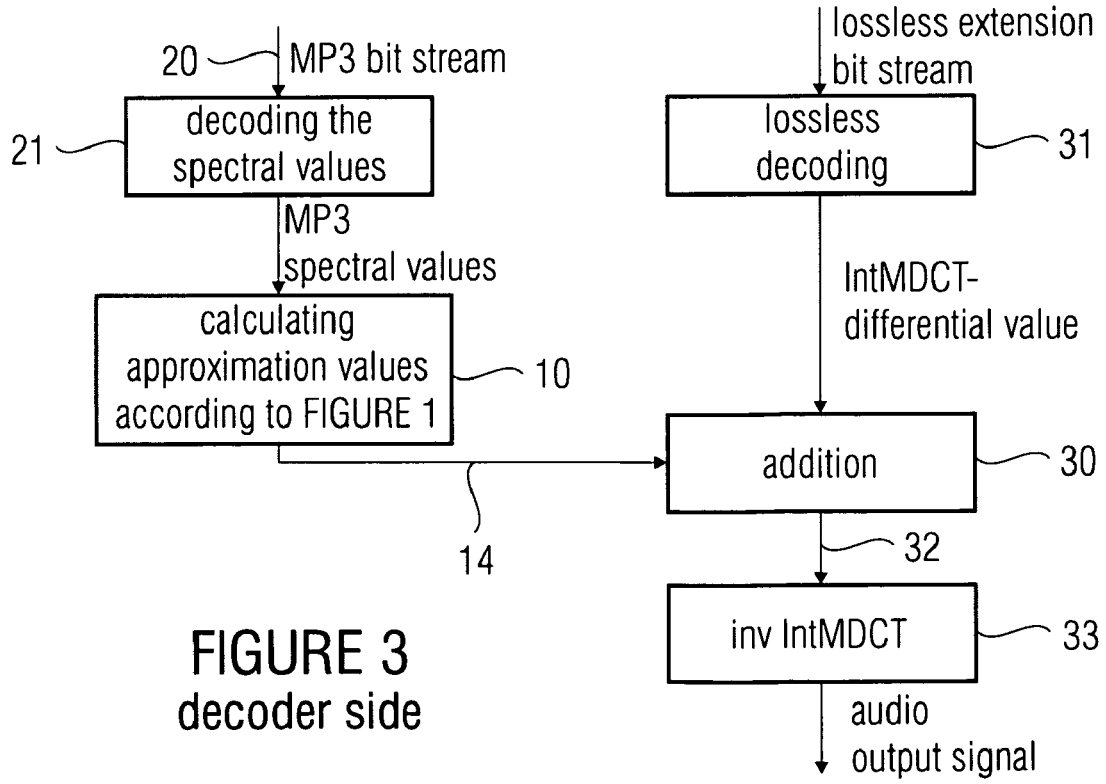
FIG. 3 is a decoder side of an inventive decoder concept.

FIG. 2 and FIG. 3 show a field of use of the inventive concept illustrated in FIG. 1 both on the encoder side (FIG. 2) and also on the decoder side (FIG. 3) of a scalable encoder. An MP3 bit stream 20 or—generally—a bit stream, respectively, as it may be obtained by a first transformation algorithm, is fed to a block 21 in order to generate the spectral values from the bit stream which are for example MP3 spectral values. The decoding of the spectral values in block 21 will thus typically include an entropy decoding and an inverse quantization.

Then, in block 10, a calculation of approximation values is performed, wherein the calculation of approximation values or of blocks of postprocessed spectral values, respectively, is performed like it was illustrated in FIG. 1. Hereupon, a difference formation is performed in a block 22, using IntMDCT spectral values, as they are obtained by an IntMDCT conversion in a block 23. Block 23 thus obtains an audio signal as an input signal from which the MP3 bit stream, like it is fed into the input 20, was obtained by encoding. The differential spectrums as they are obtained by block 22 are subjected to a lossless encoding 24 which for example includes a delta encoding, a Huffman encoding, an arithmetic encoding or any other entropy coding by which the data rate is reduced, no losses are introduced into a signal, however.

On the decoder side, the MP3 bit stream 20, as it was also fed into the input 20 of FIG. 2, is again subjected to a decoding of the spectral values by a block 21, which may correspond to block 21 of FIG. 2. Hereupon, the MP3 spectral values obtained at the output of block 21 are again processed according to FIG. 1 or block 10. On the decoder side, however, the blocks of postprocessed spectral values, as they are output by block 10, are supplied to an addition stage 30, which obtains IntMDCT differential values at its other input, as they are obtained by a lossless decoding 31 from the lossless extension bit stream which was output by block 24 in FIG. 2. By the addition of the IntMDCT differential values output by block 31 and the processed spectral values output by block 10, then, at an output 32 of the addition stage 30 blocks of IntMDCT spectral values are obtained which are a lossless representation of the original audio signal, i.e. of the audio signal which was input into block 23 of FIG. 2. The lossless audio output signal is then generated by a block 33 which performs an inverse IntMDCT in order to obtain a lossless or virtually lossless audio output signal. Generally speaking, the audio output signal at the output of block 33 has a better quality than the audio signal which would be obtained if the output signal of block 21 was processed with an MP3 synthesis hybrid filter bank. Depending on the implementation, the audio output signal at output 33 may thus be an identical reproduction of the audio signal which was input into block 23 of FIG. 2, or a representation of this audio signal, which is not identical, i.e. not completely lossless, which has, however, already a better quality than a normal MP3 coded audio signal.

At this point it is to be noted, that as a first transformation algorithm the MP3 transformation algorithm with its hybrid filter bank is advantageous, and that as a second transformation algorithm the IntMDCT algorithm as an integer transformation algorithm is advantageous. The present invention is already advantageous everywhere, however, where two transformation algorithms are different from each other, wherein both transformation algorithms do not necessarily have to be integer transformation algorithms within the scope of the IntMDCT transformation, but may also be normal transformation algorithms which are, within the scope of an MDCT, not necessarily an invertible integer transformation. According to the invention it is advantageous, however, that the first transformation algorithm is a non-integer transformation algorithm and that the second transformation algorithm is an integer transformation-algorithm, wherein the inventive postprocessing is in particular advantageous when the first transformation algorithm provides spectrums which are, compared to the spectrums provided by the second transformation algorithm, phase shifted and/or changed with regard to their amounts. In particular when the first transformation algorithm is not even perfectly reconstructing, the inventive simple postprocessing by a linear combination is especially advantageous and may efficiently be used.

FIG. 4 shows an implementation of the combiner 13 within an encoder. The implementation within a decoder is identical, however, if the adder 22 does not, like in FIG. 4, perform a difference formation, as it is illustrated by the minus sign above the adder 22, but when an addition operation is performed, as it is illustrated in block 30 of FIG. 3. In each case the values which are fed into an input 40 are values as they are obtained by the second transformation algorithm 23 of FIG. 2 for the encoder implementation or as they are obtained by block 31 of FIG. 3 in the decoder implementation.

In an embodiment of the present invention, the combiner includes three sections 41, 42, 43. Each section includes three multipliers 42*a*, 42*b*, 42*c*, wherein each multiplier is associated with a spectral value with a frequency index k−1, k or k+1. Thus, the multiplier 42*a* is associated with the frequency index k−1. The multiplier 42*b* is associated with the frequency index k and the multiplier 42*c* is associated with the frequency index k+1.

Each branch thus serves for weighting spectral values of a current block with the block index v or n+1, n or n−1, respectively, in order to obtain weighted spectral values for the current block.

Thus, the second section 42 serves for weighting spectral values of a temporally preceding block or temporally subsequent block. With regard to section 41, section 42 serves for weighting spectral values of the block n temporally following block n+1, and section 43 serves for weighting the block n−1 following block n. In order to indicate this, delay elements 44 are indicated in FIG. 4. For reasons of clarity, only one delay element "$z^{-1}$" is designated by the reference numeral 44.

In particular, each multiplier is provided with a spectral index-dependent weighting factor $c_0(k)$ to $c_8(k)$. Thus, in an embodiment of the present invention, nine weighted spectral values result, from which a postprocessed spectral value $\hat{y}$ is calculated for the frequency index k and the time block n. These nine weighted spectral values are summed up in a block 45.

The postprocessed spectral value for the frequency index k and the time index n is thus calculated by the addition of possibly differently weighted spectral values of the temporally preceding block (n−1) and the temporally subsequent block (n+1) and using respectively upwardly (k+1) and downwardly (k−1) adjacent spectral values. More simple implementations may only be, however, that a spectral value for the frequency index k is combined only with one adjacent spectral value k+1 or k−1 from the same block, wherein this spectral value which is combined with the spectral value of the frequency index k, does not necessarily have to be directly adjacent but may also be a different spectral value from the block. Due to the typical overlap of adjacent bands it is advantageous, however, to perform a combination with the directly adjacent spectral value to the top and/or to the bottom.

Further, alternatively or additionally, each spectral value with a spectral value for a different time duration, i.e. a different block index, may be combined with the corresponding spectral value from block n, wherein this spectral value from a different block does not necessarily have to have the same frequency index but may have a different, e.g. adjacent frequency index. Advantageously, however, at least the spectral value with the same frequency index from a different block is combined with the spectral value from the currently regarded block. This other block again does not necessarily have to be the direct temporally adjacent one, although this is especially advantageous when the first transformation algorithm and/or the second transformation algorithm have a block overlap characteristic, as it is typical for MP3 encoders or AAC encoders.

This means, when the weighting factors of FIG. 4 are considered, that at least the weighting factor $c_4(k)$ is unequal 0, and that at least a second weighting factor is unequal 0, while all other weighting factors may also be equal to 0, which may also already provide a processing, which may, however, due to the low number of weighting factors unequal 0 only be a relatively coarse approximation of the second transformation algorithm, if again the bottom half of FIG. 1 is regarded. In order to consider more than nine spectral values, further branches for blocks further in the future or further in the past may be added. Further, also further multipliers and further corresponding weighting factors for spectral values lying spectrally farther apart may be added, to generate a field from the 3×3 field of FIG. 4, which comprises more than three lines and/or more than three columns. It has been found, however, that when nine weighting factors are admitted for each spectral value, compared to a lower number of weighting factors, substantial improvements are achieved, while when the number of weighting factors is increased, no substantial further improvements regarding decreasing differential values at the outputs of block 22 are obtained, so that a greater number of weighting factors with typical transformation algorithms with an overlap of adjacent subband filters and a temporary overlap of adjacent blocks brings no substantial improvements.

Figure 5A:
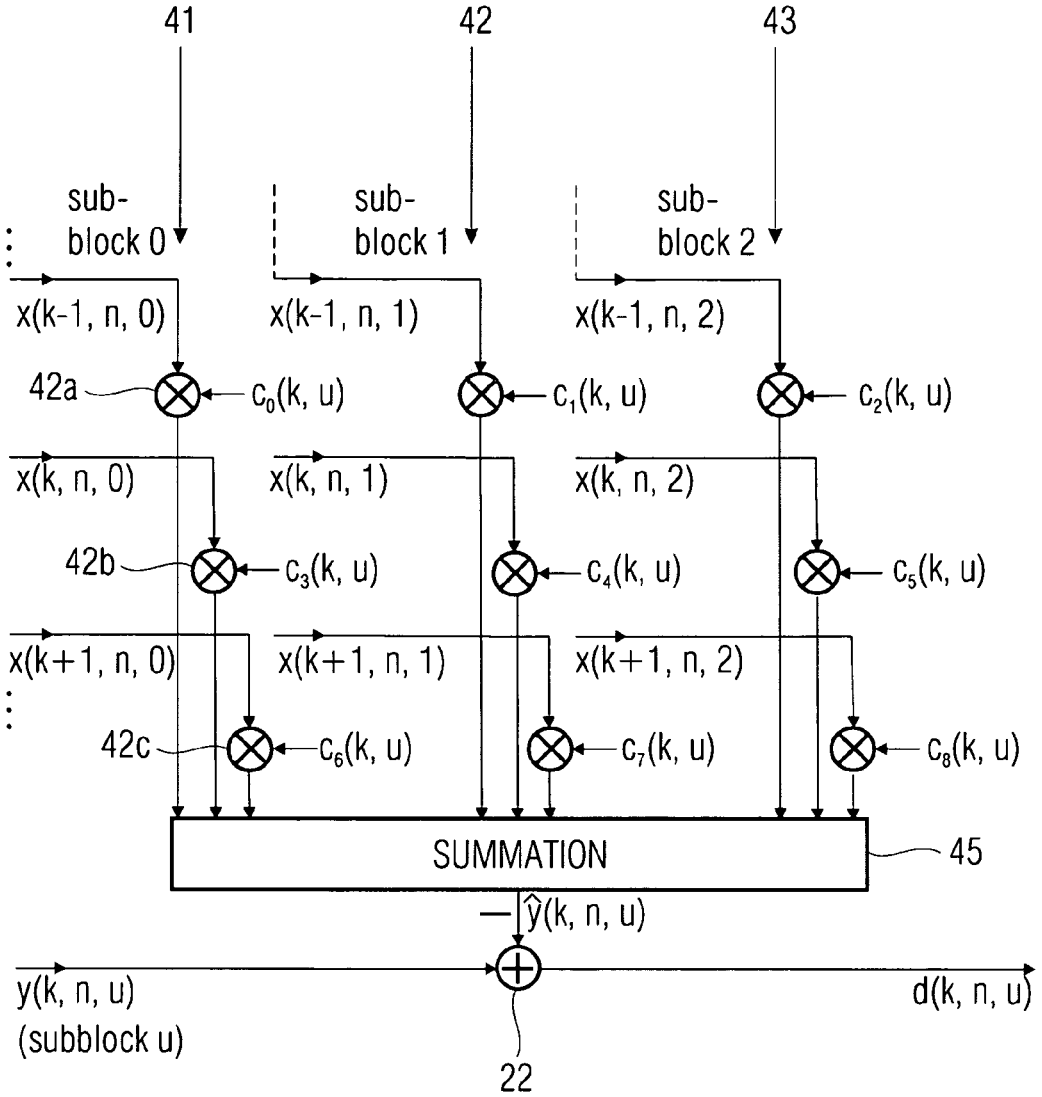
FIG. 5*a* is an implementation of the inventive postprocessing device for short blocks according to a first variant.
Figure 5B:
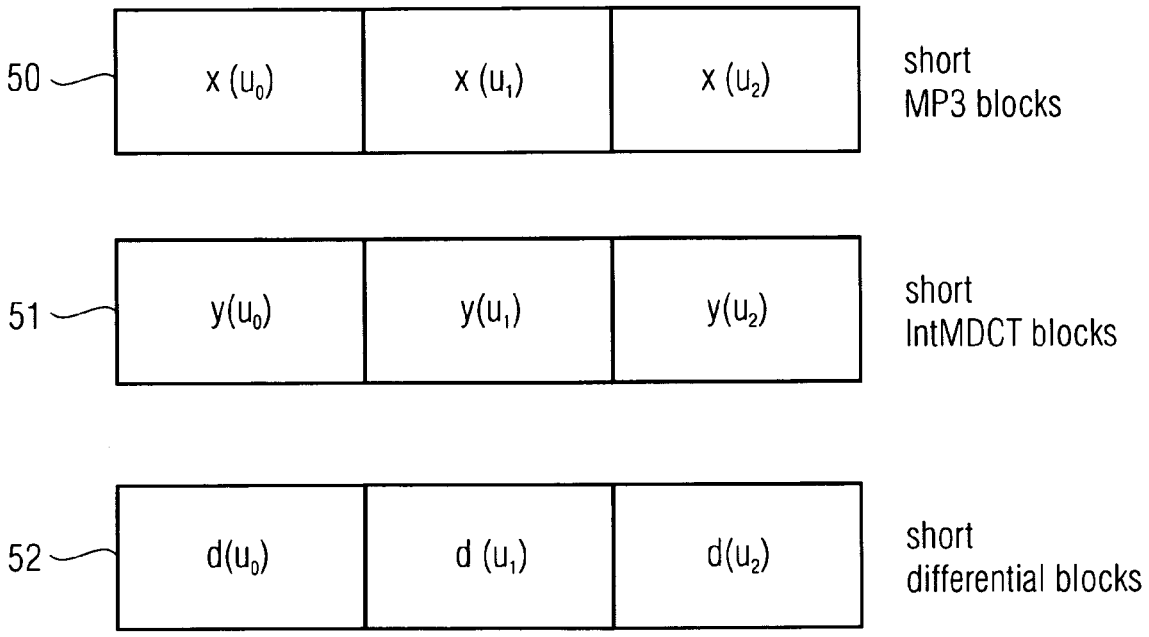
FIG. 5*b* is a schematical illustration of blocks of values belonging together for the concept shown in FIG. 5*a;*
Figure 5C:
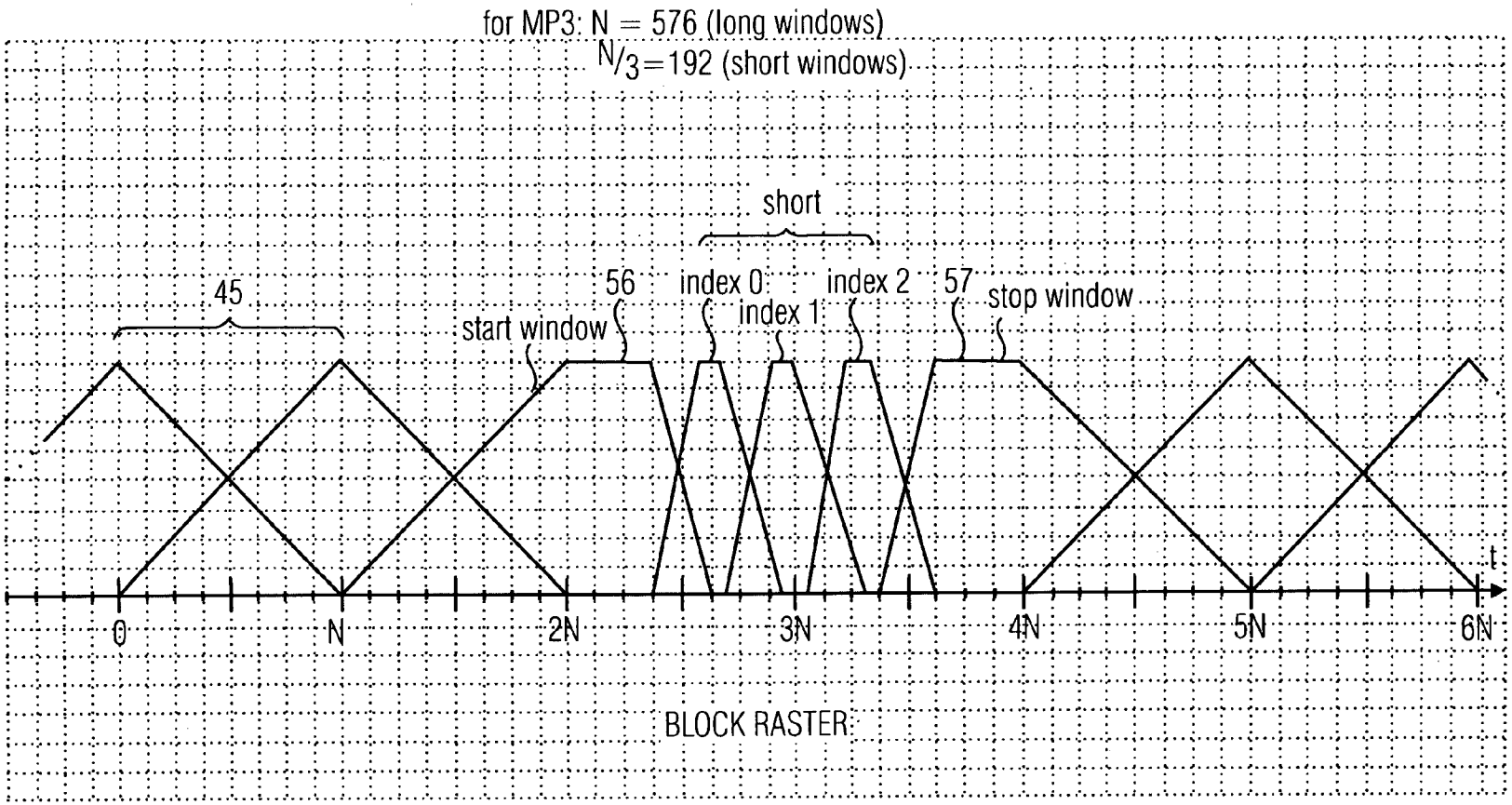
FIG. 5*c* is a sequence of windows for the variant shown in FIG. 5*a;*

Regarding the 50 percent overlap used in the sequence of long blocks, reference is made to the schematical illustration of FIG. 5*c* at 45 at the left of the figure, where two subsequent long blocks are illustrated schematically. The combiner concept illustrated in FIG. 4 is thus always used, according to the invention, when a sequence of long blocks is used, wherein the block length of the IntMDCT algorithm 23 and the degree of overlap of the IntMDCT algorithm is set equal to the degree of overlap of the MP3 analysis filter and the block length of the MP3 analysis filter. In general block overlap and block length of both transformation algorithms are set equally, which presents no special limitation, as the second transformation algorithm, i.e. for example the IntMDCT 23 of FIG. 2, may easily be set with regard to those parameters, while the same is not easily possible with the first transformation algorithm, in particular when the first transformation algorithm is standardized as with regard to the example of MP3 and is frequently used and may thus not be changed.

As it was already illustrated with reference to FIG. 2 and FIG. 3, the associated decoder in FIG. 3 reverses the difference formation again by an addition of the same approximation values, i.e. the IntMDCT differential values at the output of block 22 of FIG. 2 or at the output of block 31 of FIG. 3.

According to the invention, this method may thus generally be applied to the difference formation between spectral representations obtained using different filter banks, i.e. when one filter bank/transformation underlying the first transformation algorithm is different from a filter bank/transformation underlying the second transformation algorithm.

One example for the concrete application is the use of the MP3 spectral values from "long block" in connection with an IntMDCT, as it was described with reference to FIG. 4. As the frequency resolution of the hybrid filter bank in this case is 576, the IntMDCT will also comprise a frequency resolution of 576, so that the window length may comprise a maximum of 1152 time samples.

In the example described in the following, only the direct temporal and spectral neighbors are used, while in the general case also (or alternatively) values being farther apart may be used.

If the spectral value of the k-th band in the n-th MP3 block is designated by x(k,n) and the corresponding spectral value of the IntMDCT is designated by y(k,n), the difference is calculated as illustrated in FIG. 4 for d(k,n). $\hat{y}(k,n)$ is the approximation value for y(k,n) obtained by the linear combination, and is determined as it is illustrated by the long equation below FIG. 4.

It is to be noted here, that due to the different phase difference for each of the 576 subbands a distinct coefficient set may be necessitated. In the practical realization, as it is illustrated in FIG. 4, for an access to temporally adjacent spectral values delays 44 are used whose output values respectively correspond to input values in a corresponding preceding block. In order to enable an access to temporally subsequent spectral values, thus also the IntMDCT spectral values as they are applied to the input 40 are delayed by a delay 46.

Figure 6A:
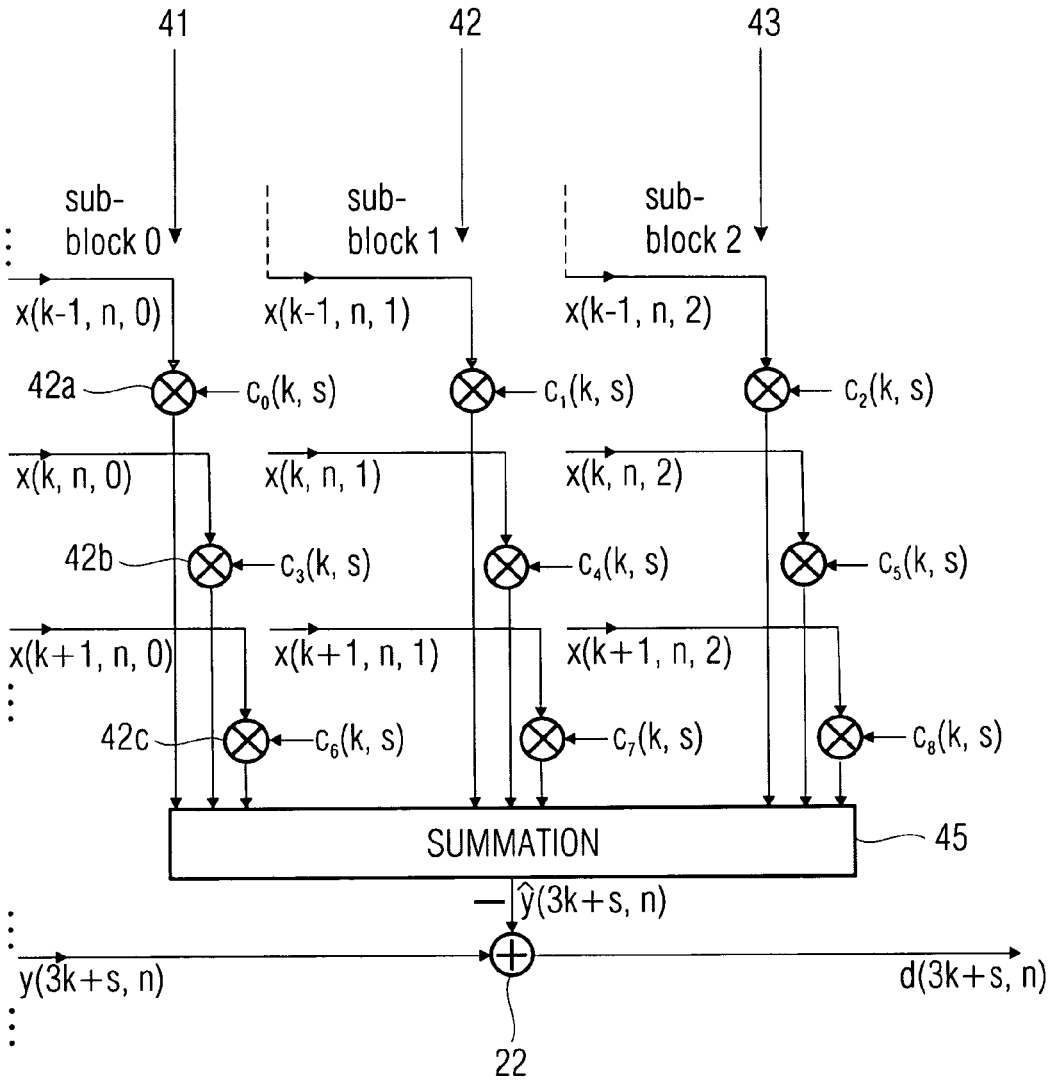
FIG. 6*a* is an implementation of the inventive postprocessing device and difference formation for short blocks according to a second variant of the present invention.

FIG. 5*a* shows a somewhat modified procedure when the MP3 hybrid filter bank provides short blocks wherein three subblocks respectively are generated by 192 spectral values, wherein here apart from the first variant of FIG. 5*a* also a second variant in FIG. 6*a* is advantageous according to the invention.

The first variant is based on a triple application of an IntMDCT with a frequency resolution 192 for forming corresponding blocks of spectral values. Here, the approximation values may be formed from the three values belonging to a frequency index and their corresponding spectral neighbors. For each subblock, here a distinct set of coefficients is necessitated. For describing the procedure thus a subblock index u is introduced, so that n again corresponds to the index of a complete block of the length 576. Expressed as an equation, thus the system of equations of FIG. 5*a* results. Such a sequence of blocks is illustrated in FIG. 5*b* with reference to the values and in FIG. 5*c* with reference to the windows. The MP3 encoder provides short MP3 blocks, as they are illustrated at 50. The first variant also provides short IntMDCT blocks $y(u_0)$, $y(u_1)$ and $y(u_2)$, as it is illustrated at 51 in FIG. 5*b*. By this, three short differential blocks 52 may be calculated such that a 1:1 representation results between a corresponding spectral value at the frequency k in blocks 50, 51 and 52.

In contrast to FIG. 4 it is to be noted, that in FIG. 5*a* delays 44 are not indicated. This results from the fact that the postprocessing may only be performed when all three subblocks 0, 1, 2 for a block n have been calculated. If the subblock with the index 0 is the temporally first subblock, and if the next subblock with the index 1 is the temporally later block, and if the index u=2 is the again temporally later short block, then the differential block for the index u=0 is calculated using spectral values from the subblock $u_0$, the subblock $u_1$ and the subblock $u_2$. This means, that only with reference to the currently calculated subblock with the index 0 future subblocks 1 and 2 are used, however no spectral value from the past. This is sensible, as a switch to short blocks was performed, as there was a transient result in the audio signal as it is known and for example illustrated in the above-mentioned expert's publication of Edler. The postprocessed values for the subblock having the index 1 used for gaining the differential values having the subblock index 1 are, however, calculated from a temporally preceding, from a temporally current and from a temporally subsequent subblock, while the postprocessed spectral values for the third subblock with the index 2 are not calculated using future subblocks but only using past subblocks having the index 1 and the index 0, which is also technically sensible in so far as again, as indicated in FIG. 5*c*, easily a window switch to long windows may be initiated by a stop window, so that later again a change directly to the long block scheme of FIG. 4 may be performed.

FIG. 5 makes thus clear that in particular with short blocks, however also generally, it may be sensible to look only into the past or into the future and not always, as indicated in FIG. 4, both into the past and also into the future, to obtain spectral values which provide a postprocessed spectral value after a weighting and a summation.

Figure 6B:
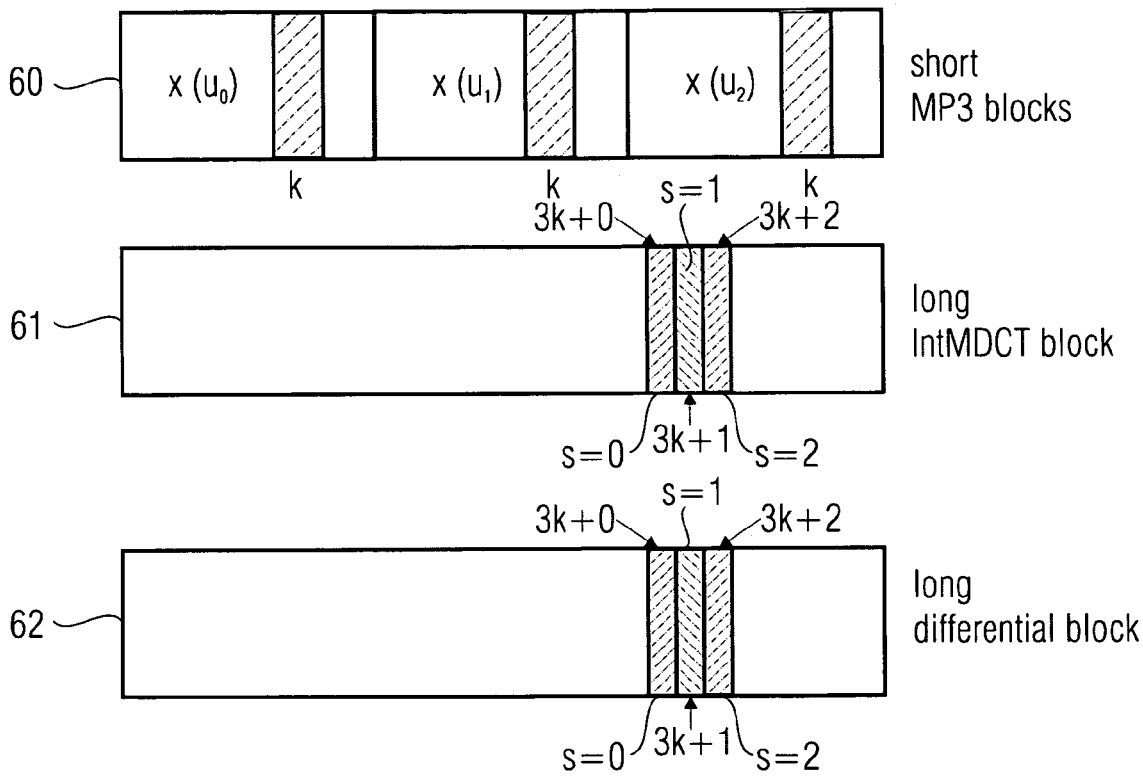
FIG. 6*b* is an illustration of diverse values for the variant illustrated in FIG. 6*a;*
Figure 6C:
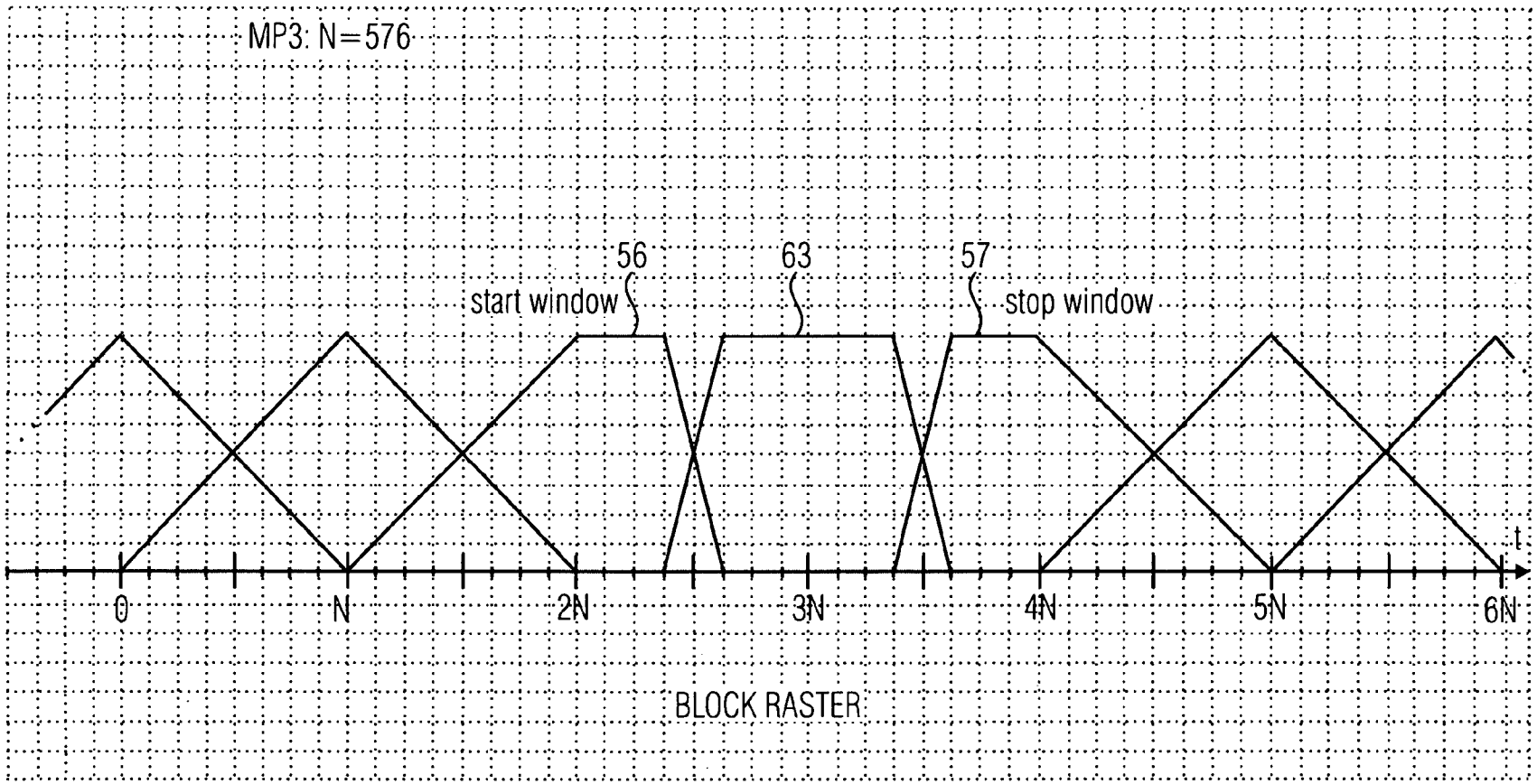
FIG. 6*c* is a block raster for the variant illustrated in FIG. 6*a;*
Figure 7:
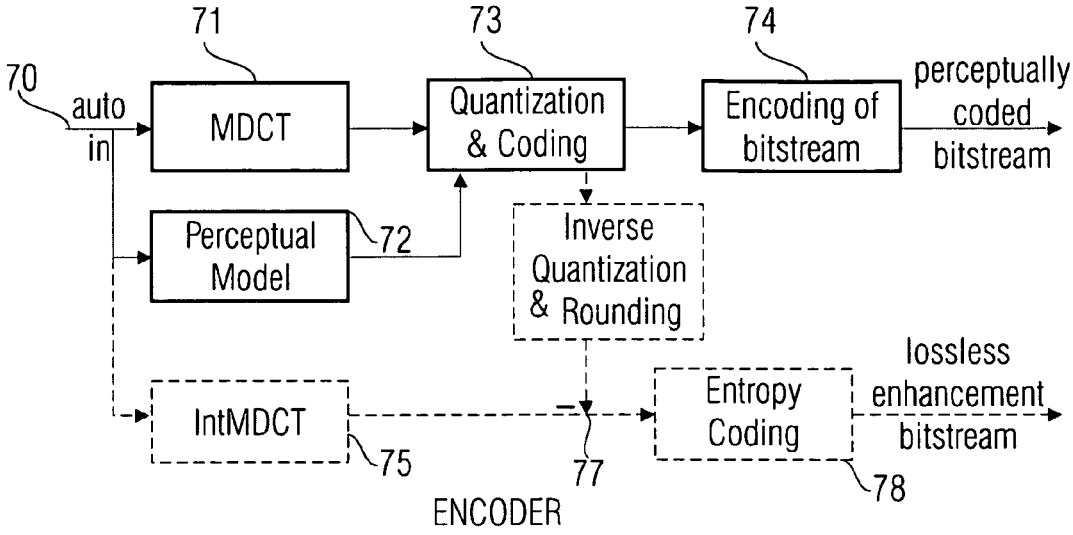
FIGURE 7 (PRIOR ART)
FIG. 7 is a conventional encoder illustration for generating a scaled data stream.
Figure 8:
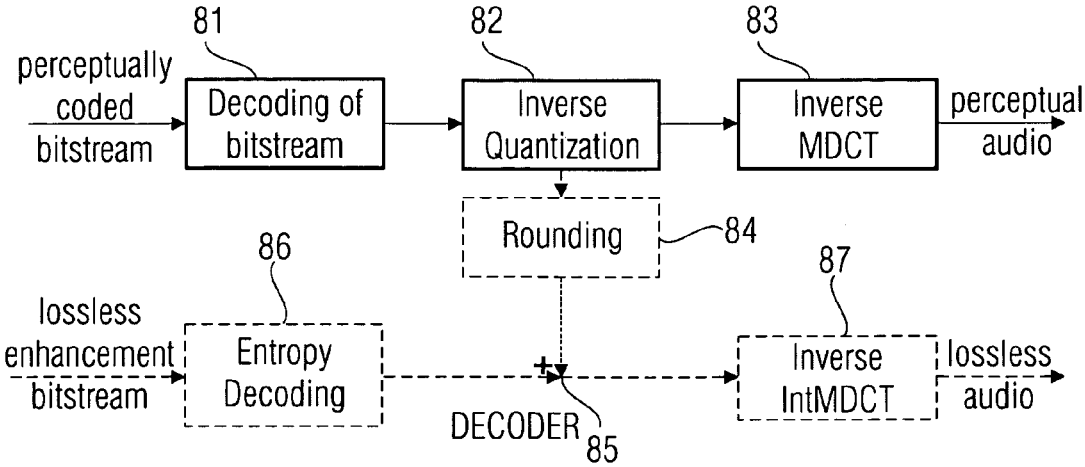
FIGURE 8 (PRIOR ART)
FIG. 8 is a conventional decoder illustration for processing a scaled data stream.
Figure 9:
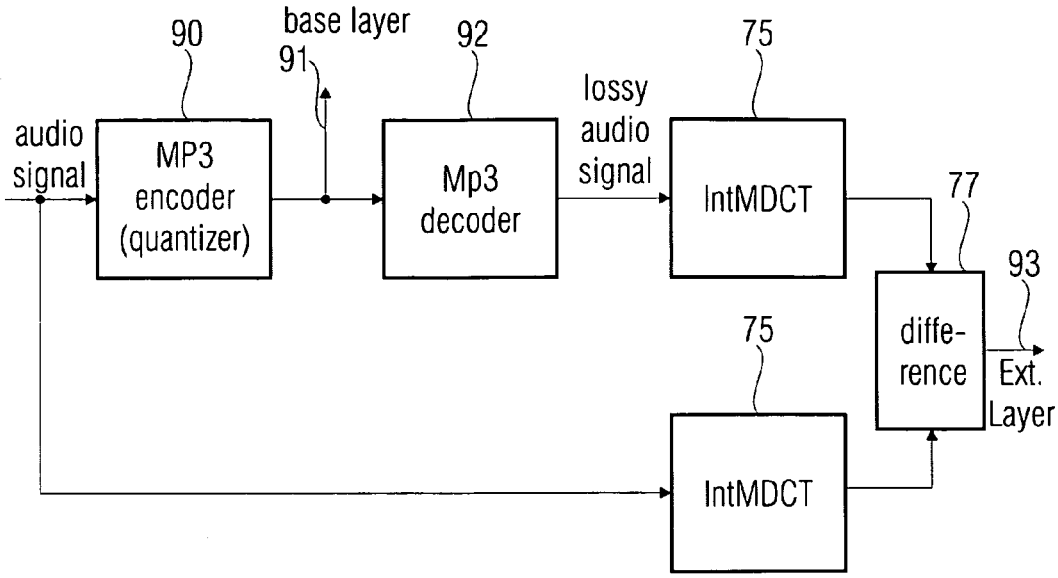
FIG. 9 is an inefficient encoder variant.
Figure 10:
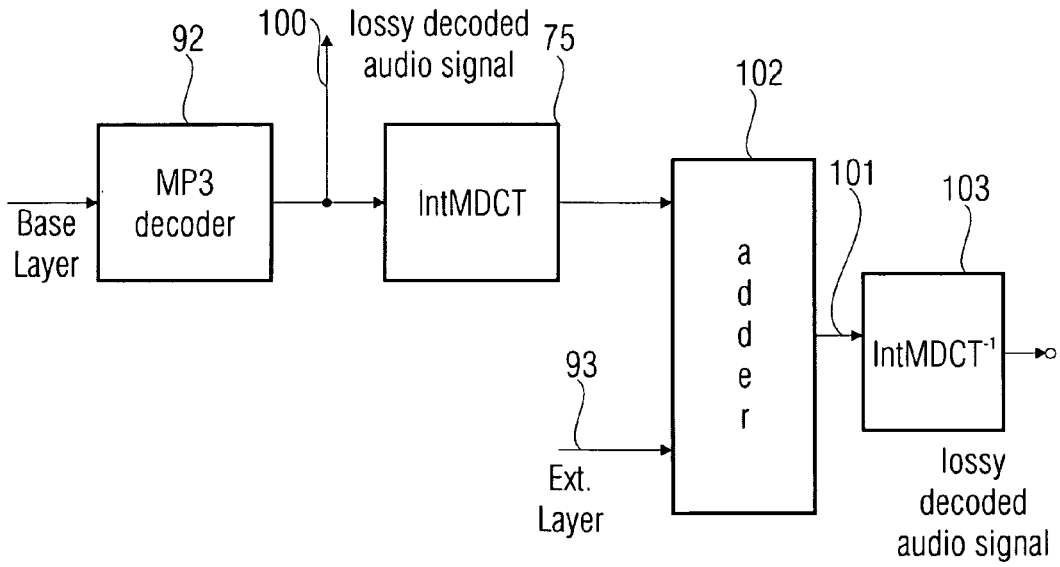
FIG. 10 is an inefficient decoder variant.

In the following, with reference to FIGS. 6*a*, 6*b* and 6*c* the second variant for short blocks is illustrated. In the second variant, the frequency resolution of the IntMDCT is still 576, so that three spectrally adjacent IntMDCT spectral values each lie in the frequency range of one MP3 spectral value. Thus, for each of those three IntMDCT spectral values, for a difference formation a distinct linear combination is formed from the three temporally subsequent subblock spectral values and their spectral neighbors, wherein the index s which is also referred to as an order index now indicates the position within each group of three. Thus, the equation as it is illustrated in FIG. 6*a* below the block diagram results. This second variant is especially suitable if a window function with a small overlap area is used in the IntMDCT, as then the considered signal section corresponds well to that of the three subblocks. In this case, like with the first variant, it is advantageous to adapt the window forms of the IntMDCT of preceding or subsequent long blocks, respectively, so that a perfect reconstruction results. A corresponding block diagram for the first variant is illustrated in FIG. 5*c*. A corresponding diagram for the second variant is illustrated in FIG. 6*c*, wherein now only one single long IntMDCT block is generated by the long window 63, wherein this long IntMDCT block now comprises k triple blocks of spectral values, wherein the bandwidth of such a triple block resulting from s=0, s=1 and s=2 is equal to the bandwidth of a block k of the short MP3 blocks 60 in FIG. 6*b*. From FIG. 6*a* it may be seen that for a subtraction from the first spectral value with s=0 for a triple block having the index k again the values of the current, the future and the next future subblock 0, 1, 2 are used, however, no values from the past are used. For calculating a differential value for the second value s=1 of a triple group, however, spectral values from the preceding subblock and the future subblock are used, while for calculating a differential spectral value having the order index s=2 only preceding subblocks are used, as it is illustrated by branches 41 and 42 which are in the past with reference to branch 43 in FIG. 6*a*.

At this point it is to be noted that with all calculation regulations the terms exceeding the limits of the frequency range, i.e. e.g. the frequency index −1 or 576 or 192, respectively, are each omitted. In these cases, in the general example in FIGS. 4 to 6 the linear combination is thus reduced to 6 instead of 9 terms.

In the following, detailed reference is made to the window sequences in FIG. 5*c* and FIG. 6*c*. The window sequences consist of a sequence of long blocks, as they are processed by the scenario in FIG. 4. Hereupon, a start window 56 follows having an asymmetrical form, as it is "converted" from a long overlapping area at the beginning of the start window to a short overlapping area at the end of the start window. Analog to this, a stop window 57 exists which is again converted from a sequence of short blocks to a sequence of long blocks and thus comprises a short overlapping area at the beginning and a long overlapping area at the end.

A window switch is, as it is illustrated in the mentioned expert's publication of Edler, selected if a time duration in the audio signal is detected by an encoder which comprises a transient signal.

Such a signaling is located in the MP3 bit stream, so that when the IntMDCT, according to FIG. 2 and according to the first variant of FIG. 5*c*, also switches to short blocks, no distinct transient detection is necessitated, but a transient detection based only on a short window notice in the MP3 bit stream takes place. For the postprocessing of values in the start window it is advantageous, due to the long overlapping area with the preceding window, to use blocks with the preceding block index n−1, while blocks with the subsequent block index are only lightly weighted or generally not used due to the short overlapping area. Analog to this, the stop window for postprocessing will only consider values with a future block index n+1 in addition to the values for the current block n, but will only perform a weak weighting or a weighting equal to 0, i.e. no use from the past, i.e. e.g. from the third short block.

When, as shown in FIG. 6*c*, the sequence of windows as it is implemented by the IntMDCT 23, i.e. the second transformation algorithm, performs no switch to short windows, however implements the used window switch, then it is advantageous to initiate or terminate, respectively, the window with the short overlap, designated by 63 in FIG. 6*c*, also by a start window 56 and by a stop window 57.

Although in the embodiment illustrated in FIG. 6*c* the IntMDCT of FIG. 2 does not change into the short window mode, the signaling of short windows in the MP3 bit stream may anyway be used to activate the window switch with a start window, window with short overlap, as it is indicated in FIG. 6*c* at 63, and stop window.

Further it is to be noted, that in particular the window sequences illustrated in the AAC standard, adapted to the MP3 block length or the MP3 feed, respectively, of 576 values for long blocks and 192 values for short blocks, and in particular also the start windows and stop windows illustrated there, are especially suitable for an implementation of the IntMDCT in block 23 of the present invention.

In the following, reference is made to the accuracy of the approximation of first transformation algorithm and postprocessing.

For 576 input signals respectively having one impulse at the position 0 . . . 575 within a block, the following steps were performed:

- calculating the hybrid filter bank+approximation
- calculating the MDCT
- calculating the square sum of the MDCT spectral components
- calculating the square sum of the deviations between MDCT spectral components and the approximation. Here, the maximum square deviation across all 576 signals is determined.

The maximum relative square deviation across all positions was, when using

- long blocks according to FIG. 4, approx. 3.3%
- short blocks (hybrid) and long blocks (MDCT) according to FIG. 6, approx. 20.6%.

One could thus say, that with an impulse at the inputs of the two transformations, the square sum of the deviations between the approximation and the spectral components of the second transformation should not be more than 30% (and not even more than 25% or 10% respectively) of the square sum of the spectral components of the second transformation, independent of the position of the impulse in the input block. For calculating the square sums, all blocks of spectral components should be considered which are influenced by the impulse.

It is to be noted, that in the above error inspection (MDCT versus hybrid FB+postprocessing) always the relative error was considered which is signal independent.

In the IntMDCT (versus MDCT), however, the absolute error is signal independent and lies in a range of around −2 to 2 of the rounded integer values. From this it results that the relative error becomes signal dependent. In order to eliminate this signal dependency, a fully controlled impulse is assumed (e.g. value 32767 at 16 bit PCM).

This will then result in a virtually flat spectrum with an average amplitude of about 32767/sqrt (576)=1365 (energy conservation). The mean square error would then be about 2^2/1365^2=0.0002%, i.e. negligible.

With a very low impulse at the input, the error would be drastical, however. An impulse of the amplitude 1 or 2 would virtually completely be lost in the IntMDCT approximation error.

The error criterion of the accuracy of the approximation, i.e. the value desired for the weighting factors, is thus best comparable, when it is indicated for a fully controlled impulse.

Depending on the circumstances, the inventive method may be implemented in hardware or in software. The implementation may take place on a digital storage medium, in particular a floppy disc or a CD having electronically readable control signals, which may cooperate with a programmable computer system so that the method is performed. In general, the invention thus also consists in a computer program product having a program code stored on a machine-readable carrier for performing the inventive method, when the computer program product runs on a computer. In other words, the invention may thus be realized as a computer program having a program code for performing the method, when the computer program runs on a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A device for postprocessing spectral values based on a first transformation algorithm for converting an audio signal into a spectral representation, comprising:

a provider for providing a sequence of blocks of the spectral values representing a sequence of blocks of samples of the audio signal; and a combiner for weightedly adding spectral values of the sequence of blocks of spectral values in order to acquire a sequence of blocks of postprocessed spectral values, wherein the combiner is implemented to use, for the calculation of a postprocessed spectral value for a frequency band and a time duration, a spectral value of the sequence of blocks for the frequency band and the time duration, and a spectral value for another frequency band or another time duration, and wherein the combiner is implemented to use such weighting factors when weightedly adding, that the postprocessed spectral values are an approximation to spectral values as they are acquired by a second transformation algorithm for converting the audio signal into a spectral representation, wherein the second transformation algorithm is different from the first transformation algorithm.

2. The device according to claim 1, wherein the first transformation algorithm is a hybrid transformation algorithm comprising two stages, and the second transformation algorithm is a one-stage transformation algorithm.

3. The device according to claim 1, wherein the first transformation algorithm comprises a polyphase filter bank and a modified discrete cosine transformation, and wherein the second transformation algorithm is an integer MDCT.

4. The device according to claim 1, wherein the first transformation algorithm and the second transformation algorithm are implemented so that they provide real output signals.

5. The device according to claim 1, wherein the combiner is implemented to use such weighting factors that the first transformation algorithm and a postprocessing performed by the combiner together provide an impulse response which approximates an impulse response of the second transformation algorithm.

6. The device according to claim 5, wherein in an approximation from the first transformation algorithm and postprocessing, the weighting factors are selected such that with an impulse at the input of the two transformations the square sum of the deviations between the approximation and the spectral components of the second transformation is no more than 30% of the square sum of the spectral components of the second transformation.

7. The device according to claim 1, wherein the provider for providing a sequence of blocks is implemented to provide blocks which are a lossy representation of the audio signal.

8. The device according to claim 1, wherein the combiner for a calculation of a postprocessed spectral value for a frequency band k comprises:

a first section for weighting spectral values of a current block for the frequency band k, a frequency band k−1 or a frequency band k+1, in order to acquire weighted spectral values for the current block;

a second section for weighting spectral values of a temporally preceding block k−1 or temporally subsequent block k+1, in order to acquire weighted spectral values for the temporally preceding block or the temporally subsequent block; and an adder for adding the weighted spectral values to acquire a postprocessed spectral value for the frequency band k of a current or preceding or subsequent block of postprocessed spectral values.

9. The device according to claim 8, further comprising:

a third section for weighting spectral values of a preceding block, wherein the first section is implemented to weight spectral values of a subsequent block, and wherein the second section is implemented to weight spectral values of a current block, and wherein the summer is implemented to add weighted spectral values of the three sections in order to acquire a postprocessed spectral value for the current block of postprocessed spectral values.

10. The device according to claim 1, wherein the first transformation algorithm comprises a block overlap function, wherein blocks of samples of the time audio signal which the sequence of blocks of spectral values is based on overlap.

11. The device according to claim 1, wherein the combiner is implemented to use a signal independent set of weighting factors for each spectral value.

12. The device according to claim 1, wherein the sequence of blocks of the spectral values comprises a set of blocks of spectral values which are shorter than a long block of spectral values which follows after the set of blocks or which precedes the set of blocks, and wherein the combiner is implemented to use the same frequency band or an adjacent frequency band out of several blocks of the set of short blocks for calculating a postprocessed spectral value for the set of blocks of spectral values.

13. The device according to claim 12, wherein the combiner is implemented to use only spectral values of short blocks and no spectral value of a preceding long block or a subsequent long block for calculating postprocessed spectral values due to short blocks of spectral values.

14. The device according to claim 1, wherein the combiner is implemented to implement the following equation:

$$\hat{y}(k,n)=c_0(k)\times(k-1,n-1)+c_1(k)\times(k-1,n)+c_2(k)\times(k-1,n+1)+c_3(k)\times(k,n-1)+c_4(k)\times(k,n)+c_5(k)\times(k,n+1)+c_6(k)\times(k+1,n-1)+c_7(k)\times(k+1,n)+c_8(k)\times(k+1,n+1)$$

wherein $\hat{y}(k,n)$ is a postprocessed spectral value for a frequency index k and a time index n, wherein x(k,n) is a spectral value of a block of spectral values with a frequency index k and a time index n, wherein $c_0(k), \ldots, c_8(k)$ are weighting factors, associated with the frequency index k, wherein k−1 is a decremented frequency index, wherein k+1 is an incremented frequency index, wherein n−1 is a decremented time index and wherein n+1 is an incremented time index.

15. The device according to claim 1, wherein the combiner is implemented to implement the following equation:

$$\hat{y}(k,n,u)=c_0(k,u)\times(k-1,n,0)c_1(k,u)\times(k-1,n,1)+c_2(k,u)\times(k-1,n,2)+c_3(k,u)\times(k,n,0)+c_4(k,u)\times(k,n,1)+c_5(k,u)\times(k,n,2)+c_6(k,u)\times(k+1,n,0)+c_7(k,u)\times(k+1,n,1)+c_8(k,u)\times(k+1,n,2)$$

wherein $\hat{y}(k,n,u)$ is a postprocessed spectral value for a frequency index k and a time index n and a subblock index u, wherein x(k,n,u) is a spectral value of a block of spectral values with a frequency index k and a time index n and a subblock index u, wherein $c_0(k), \ldots, c_8(k)$ are weighting factors associated with the frequency index k, wherein k−1 is a decremented frequency index, wherein k+1 is an incremented frequency index, wherein n−1 is a decremented time index and wherein n+1 is an incremented time index, wherein u is a subblock index indicating a position of a subblock in a sequence of subblocks, and wherein the time index specifies a long block and the subblock index specifies a comparatively short block.

16. The device according to claim 1, wherein the combiner is implemented in order to implement the following equation:

$$\hat{y}(3k+s,n)=c_0(k,s)\times(k-1,n,0)+c_1(k,s)\times(k-1,n,1)+c_2(k,s)\times(k-1,n,2)+c_3(k,s)\times(k,n,0)+c_4(k,s)\times(k,n,1)+c_5(k,s)\times(k,n,2)+c_6(k,s)\times(k+1,n,0)+c_1(k,s)\times(k+1,n,1)+c_8(k,s)\times(k+1,n,2)$$

wherein $\hat{y}(k,n)$ is a postprocessed spectral value for a frequency index k and a time index n, wherein x(k,n,u) is a spectral value of a block of spectral values with a frequency index k and a time index n and a subblock index u, wherein $c_0(k), \ldots, c_8(k)$ are weighting factors associated with the frequency index k, wherein k−1 is a decremented frequency index, wherein k+1 is an incremented frequency index, wherein n−1 is a decremented time index and wherein n+1 is an incremented time index, wherein s is a order index indicating a position of a subblock in a sequence of subblocks, and wherein the time index specifies a long block and the subblock index specifies a comparatively short block.

17. An encoder for encoding an audio signal, comprising:

a device for postprocessing spectral values based on a first transformation algorithm for converting an audio signal into a spectral representation, comprising:

a provider for providing a sequence of blocks of the spectral values representing a sequence of blocks of samples of the audio signal; and a combiner for weightedly adding spectral values of the sequence of blocks of spectral values in order to acquire a sequence of blocks of postprocessed spectral values, wherein the combiner is implemented to use, for the calculation of a postprocessed spectral value for a frequency band and a time duration, a spectral value of the sequence of blocks for the frequency band and the time duration, and a spectral value for another frequency band or another time duration, and wherein the combiner is implemented to use such weighting factors when weightedly adding, that the postprocessed spectral values are an approximation to spectral values as they are acquired by a second transformation algorithm for converting the audio signal into a spectral representation, wherein the second transformation algorithm is different from the first transformation algorithm;

a calculator for calculating a sequence of blocks of spectral values according to the second transformation algorithm from the audio signal;

a former for a spectral-value-wise difference formation between the sequence of blocks due to the second transformation algorithm and the sequence of blocks of postprocessed spectral values.

18. The encoder according to claim 17, further comprising:

a generator for generating an extension bit stream due to a result generated by the former for a spectral-value-wise difference formation.

19. The encoder according to claim 18, wherein the generator comprises an entropy encoder.

20. The encoder according to claim 17, wherein the sequence of blocks due to the first transformation algorithm is based on a lossy compression, and wherein the sequence of blocks due to the second transformation algorithm is based on a lossless or virtually lossless compression.

21. The encoder according to claim 17, comprising a memory for storing the weighting factors in which the weighting factors are storable independent of a signal.

22. The encoder according to claim 17, wherein the generator for generating the sequence of blocks using the second transformation algorithm is implemented to perform a windowing with a window sequence which depends on a window sequence which the sequence of blocks of the spectral values is based on which is given due to the first transformation algorithm.

23. The encoder according to claim 22, wherein the provider for providing a sequence of blocks using the second transformation algorithm is implemented to switch from a long window with a long overlapping area to a long window with a short overlapping area or to a plurality of short windows, when in the sequence of blocks of the spectral values due to the first transformation algorithm a switch to short windows takes place.

24. A decoder for decoding an encoded audio signal, comprising:

a device for postprocessing spectral values based on a first transformation algorithm for converting an audio signal into a spectral representation, comprising:

a provider for providing a sequence of blocks of the spectral values representing a sequence of blocks of samples of the audio signal; and a combiner for weightedly adding spectral values of the sequence of blocks of spectral values in order to acquire a sequence of blocks of postprocessed spectral values, wherein the combiner is implemented to use, for the calculation of a postprocessed spectral value for a frequency band and a time duration, a spectral value of the sequence of blocks for the frequency band and the time duration, and a spectral value for another frequency band or another time duration, and wherein the combiner is implemented to use such weighting factors when weightedly adding, that the postprocessed spectral values are an approximation to spectral values as they are acquired by a second transformation algorithm for converting the audio signal into a spectral representation, wherein the second transformation algorithm is different from the first transformation algorithm;

a provider for providing spectral-value-wise differential values between a sequence of blocks of postprocessed spectral values due to the first transformation algorithm and a sequence of blocks due to the second transformation algorithm;

a combiner for combining the sequence of blocks of the postprocessed spectral values and the differential values in order to acquire a sequence of blocks of combination spectral values; and a transformer for inversely transforming the sequence of blocks of combination spectral values according to the second transformation algorithm to acquire a decoded audio signal.

25. A method for postprocessing spectral values which are based on a first transformation algorithm for converting an audio signal into a spectral representation, comprising:

providing, by using a provider, a sequence of blocks of the spectral values representing a sequence of blocks of samples of the audio signal; and weightedly adding, by using a combiner, spectral values of the sequence of blocks of spectral values to acquire a sequence of blocks of postprocessed spectral values, wherein for calculating a postprocessed spectral value for a frequency band and a time duration a spectral value of the sequence of blocks for the frequency band and the time duration and a spectral value for another frequency band or another time duration are used, and wherein such weighting factors are used when weightedly adding so that the postprocessed spectral values are an approximation to spectral values as they are acquired by a second transformation algorithm for converting the audio signal into a spectral representation, wherein the second transformation algorithm is different from the first transformation algorithm, wherein at least one of the provider and the combiner comprises a hardware device.

26. A method for encoding an audio signal, comprising:

postprocessing, by using a device for postprocessing, spectral values which are based on a first transformation algorithm for converting an audio signal into a spectral representation, comprising:

providing a sequence of blocks of the spectral values representing a sequence of blocks of samples of the audio signal; and weightedly adding of spectral values of the sequence of blocks of spectral values to acquire a sequence of blocks of postprocessed spectral values, wherein for calculating a postprocessed spectral value for a frequency band and a time duration a spectral value of the sequence of blocks for the frequency band and the time duration and a spectral value for another frequency band or another time duration are used, and wherein such weighting factors are used when weightedly adding so that the postprocessed spectral values are an approximation to spectral values as they are acquired by a second transformation algorithm for converting the audio signal into a spectral representation, wherein the second transformation algorithm is different from the first transformation algorithm;

calculating, by using a calculator, a sequence of blocks of spectral values according to the second transformation algorithm from the audio signal;

spectral-value-wise difference formation, by using a former, between the sequence of blocks of spectral values due to the second transformation algorithm and the sequence of blocks of postprocessed spectral values, wherein at least one of the device for postprocessing, the calculator, and the former comprises a hardware device.

27. A method for decoding an encoded audio signal, comprising:

postprocessing, by using a device for postprocessing, spectral values which are based on a first transformation algorithm for converting an audio signal into a spectral representation, comprising:

providing a sequence of blocks of the spectral values representing a sequence of blocks of samples of the audio signal; and weightedly adding of spectral values of the sequence of blocks of spectral values to acquire a sequence of blocks of postprocessed spectral values, wherein for calculating a postprocessed spectral value for a frequency band and a time duration a spectral value of the sequence of blocks for the frequency band and the time duration and a spectral value for another frequency band or another time duration are used, and wherein such weighting factors are used when weightedly adding so that the postprocessed spectral values are an approximation to spectral values as they are acquired by a second transformation algorithm for converting the audio signal into a spectral representation, wherein the second transformation algorithm is different from the first transformation algorithm;

providing, by using a provider, spectral-value-wise differential values between a sequence of blocks of postprocessed spectral values due to the first transformation algorithm and a sequence of blocks of spectral values due to the second transformation algorithm;

combining, by using a combiner, the sequence of blocks of the postprocessed spectral values and the differential values to acquire a sequence of blocks of combination spectral values; and inversely transforming, by using a transformer, the sequence of blocks of combination spectral values according to the second transformation algorithm to acquire a decoded audio signal, wherein at least one of the device for postprocessing, the provider, the combiner, and the transformer comprises a hardware device.

28. A non-transitory computer readable medium having stored thereon a computer program comprising a program code for performing, when the computer program runs on a computer, a method for postprocessing spectral values which are based on a first transformation algorithm for converting an audio signal into a spectral representation, the method comprising:

providing a sequence of blocks of the spectral values representing a sequence of blocks of samples of the audio signal; and weightedly adding of spectral values of the sequence of blocks of spectral values to acquire a sequence of blocks of postprocessed spectral values, wherein for calculating a postprocessed spectral value for a frequency band and a time duration a spectral value of the sequence of blocks for the frequency band and the time duration and a spectral value for another frequency band or another time duration are used, and wherein such weighting factors are used when weightedly adding so that the postprocessed spectral values are an approximation to spectral values as they are acquired by a second transformation algorithm for converting the audio signal into a spectral representation, wherein the second transformation algorithm is different from the first transformation algorithm.

* * * * *